US009265984B2

(12) United States Patent
Huber

(10) Patent No.: US 9,265,984 B2
(45) Date of Patent: Feb. 23, 2016

(54) EXERCISE DEVICE USING UNDULATION MEMBERS

(71) Applicant: Aaron D. Huber, Louisville, OH (US)

(72) Inventor: Aaron D. Huber, Louisville, OH (US)

( * ) Notice: Subject to any disclaimer, the term of this patent is extended or adjusted under 35 U.S.C. 154(b) by 156 days.

(21) Appl. No.: 14/084,099

(22) Filed: Nov. 19, 2013

(65) Prior Publication Data

US 2014/0141946 A1 May 22, 2014

Related U.S. Application Data

(60) Provisional application No. 61/828,109, filed on May 28, 2013, provisional application No. 61/727,918, filed on Nov. 19, 2012.

(51) Int. Cl.

| | |
|---|---|
| ***A63B 21/16*** | (2006.01) |
| ***A63B 21/08*** | (2006.01) |
| ***A63B 71/02*** | (2006.01) |
| ***A63B 21/00*** | (2006.01) |
| ***A63B 23/035*** | (2006.01) |
| ***A63B 23/12*** | (2006.01) |
| *A63B 21/005* | (2006.01) |

(Continued)

(52) U.S. Cl.

CPC ..... *A63B 21/16* (2013.01); *A63B 21/1484* (2013.01); *A63B 21/169* (2015.10); *A63B 21/4043* (2015.10); *A63B 23/03541* (2013.01); *A63B 23/1209* (2013.01); *A63B 71/023* (2013.01); *A63B 21/0051* (2013.01); *A63B 21/015* (2013.01); *A63B 21/0552* (2013.01); *A63B 21/06* (2013.01); *A63B 21/0603* (2013.01); *A63B 21/08* (2013.01); *A63B 21/154* (2013.01); *A63B 21/1636* (2013.01); *A63B 21/1645* (2013.01); *A63B 2021/169* (2013.01); *A63B 2071/0063* (2013.01); *A63B 2071/025* (2013.01); *A63B 2071/026* (2013.01)

(58) Field of Classification Search

CPC ..... A63B 21/1469; A63B 21/0552; A63B 21/1484; A63B 21/154; A63B 21/0557; A63B 21/055; A63B 2225/09; A63B 21/04; A63B 21/0555; A63B 7/02; A63B 21/16; A63B 21/08; A63B 21/06; A63B 21/018; A63B 21/02; A63B 21/028; A63B 21/0407; A63B 21/0414; A63B 21/0421; A63B 21/0428; A63B 21/0435; A63B 21/0442

USPC ..... 482/79, 92–94, 99, 121, 126, 139, 110

See application file for complete search history.

(56) References Cited

U.S. PATENT DOCUMENTS 4,084,815 A * 4/1978 Flannery ..... 482/94
5,468,205 A 11/1995 McFall et al.

(Continued)

OTHER PUBLICATIONS

National Center for Biotechnology Information. U.S. National Library of Medicine, n.d. Web. Dec. 30, 2013. <http://www.ncbi.nlm.nih.gov/pubmed/16696264>.

(Continued)

*Primary Examiner* — Loan H Thanh
*Assistant Examiner* — Andrew S Lo
(74) *Attorney, Agent, or Firm* — Sand & Sebolt

(57) ABSTRACT

An exercise device and a method of exercising includes one or more undulation members, such as ropes, which a user undulates, which may cause an elastic line to stretch and/or a travel line to travel around one or more pulleys. The exercise device is configured to allow exercise using undulation members in a relatively small space.

19 Claims, 23 Drawing Sheets

(51) Int. Cl.

| | |
|---|---|
| *A63B 21/015* | (2006.01) |
| *A63B 21/055* | (2006.01) |
| *A63B 21/06* | (2006.01) |
| *A63B 71/00* | (2006.01) |

(56) References Cited

U.S. PATENT DOCUMENTS

| | | | | |
|---|---|---|---|---|
| 6,059,698 | A | 5/2000 | Mazor | |
| 7,976,445 | B2 | 7/2011 | Lalaoua | |
| 8,033,960 | B1 | 10/2011 | Dalebout et al. | |
| 8,827,231 | B1 * | 9/2014 | Blair | 248/507 |
| 2006/0105888 | A1 * | 5/2006 | Piane | 482/94 |
| 2006/0135329 | A1 * | 6/2006 | Owen | 482/123 |
| 2011/0177921 | A1 | 7/2011 | Olson et al. | |
| 2014/0113777 | A1 * | 4/2014 | Pahl | 482/93 |
| 2014/0274612 | A1 * | 9/2014 | Pesko | 482/139 |

OTHER PUBLICATIONS

New research cautions using exercise balls as chairs. (n.d.). Hawaii Army Weekly. Retrieved Dec. 30, 2013, from http://www.hawaiiarmyweekly.com/2012/06/22/new-research-cautions-using-exercise-balls-as-chairs/.

Replacing Office Chairs with Exercise Balls?. (n.d.). Humantech Replacing Office Chairs with Exercise Balls Comments. Retrieved Dec. 30, 2013, from http://www.humantech.com/blog/replacing-office-chairs-with-exercise-balls/.

National Center for Biotechnology Information. Retrieved Dec. 30, 2013, from http://www.ncbi.nlm.nih.gov/pubmed/16696264.

Gregory, Dunk, and Callaghan, "Stability Ball Versus Office Chair: Comparison of Muscle Activation and Lumbar Spine Posture During Prolonged Sitting," Human Factors, vol. 48, No. 1, Spring 2006.

* cited by examiner

EXERCISE DEVICE USING UNDULATION MEMBERS

CROSS REFERENCE TO RELATED APPLICATIONS

This application is a non-provisional application claiming priority from U.S. Provisional Patent Application Ser. No. 61/727,918, filed Nov. 19, 2012, and U.S. Provisional Patent Application Ser. No. 61/828,109, filed May 28, 2013, the disclosures of which are incorporated herein by reference

BACKGROUND OF THE INVENTION

1. Technical Field

The invention generally relates to exercise devices. More particularly, the invention relates to an exercise device using an undulation member which undulates as the user moves the undulation member back and forth.

2. Background Information

An exercise which has become popular in recent times is the use of relatively heavy ropes having an outer diameter of about 1.5 or 2 inches in which a relatively long rope of 20 to 100 feet is grasped along one end whereby the user moves one or both hands up and down or back and forth to the side in order to cause the rope to undulate along the length of the rope. Although use of these so-called "battle ropes" provides a good exercise workout, one of the key problems related to the use of such ropes is the length thereof and thus the amount of valuable horizontal floor space that is taken up by such ropes. In addition, although such ropes have been used in various commercial gyms, they are largely impractical for most residential uses and smaller commercial facilities, for instance, personal training studios, medical rehabilitation units, senior living centers and so forth. The present invention resolves these problems.

SUMMARY

In one aspect, the invention may provide a method of exercising comprising the steps of providing an exercise device which includes a first undulation assembly comprising an elongated first undulation member, and a first shock-absorbing assembly comprising a first elastic line, wherein the first undulation member is operatively connected to the first shock-absorbing assembly; gripping the first undulation assembly with a first hand at a first gripping location distal the first elastic line; and during the step of gripping, moving the first hand in a back and forth manner to cause undulation of the first undulation member, thereby causing the first elastic line to stretch.

In another aspect, the invention may provide a method of exercising comprising the steps of providing an exercise device which includes an undulation assembly comprising an elongated undulation member, a rotatable sheave and a travel line wrapped around the sheave, wherein the undulation member is operatively connected to the travel line; gripping the undulation assembly with a hand at a gripping location distal the travel line; and during the step of gripping, moving the hand in a back and forth manner to cause undulation of the undulation member, thereby causing the travel line to travel around and rotate the sheave.

In another aspect, the invention may provide a method of exercising comprising the steps of providing an exercise device which includes an undulation assembly comprising an elongated undulation member having first and second opposed ends, and a shock-absorbing assembly comprising a closed loop which includes an elastic line wrapped around first and second rotatable sheaves; wherein the first end of the undulation member is operatively connected to the shock-absorbing assembly; gripping the undulation assembly with a hand at a gripping location adjacent the second end of the undulation member; and during the step of gripping, moving the hand in a back and forth manner to cause undulation of the undulation member including back and forth movement of the first end of the undulation member, thereby causing the elastic line to stretch and to travel around and rotate the first and second sheaves.

BRIEF DESCRIPTION OF THE SEVERAL VIEWS OF THE DRAWINGS

A sample embodiment of the invention, illustrative of the best mode in which Applicant contemplates applying the principles, is set forth in the following description, is shown in the drawings and is particularly and distinctly pointed out and set forth in the appended claims.

Similar numbers refer to similar parts throughout the drawings.

DETAILED DESCRIPTION

Figure 1:
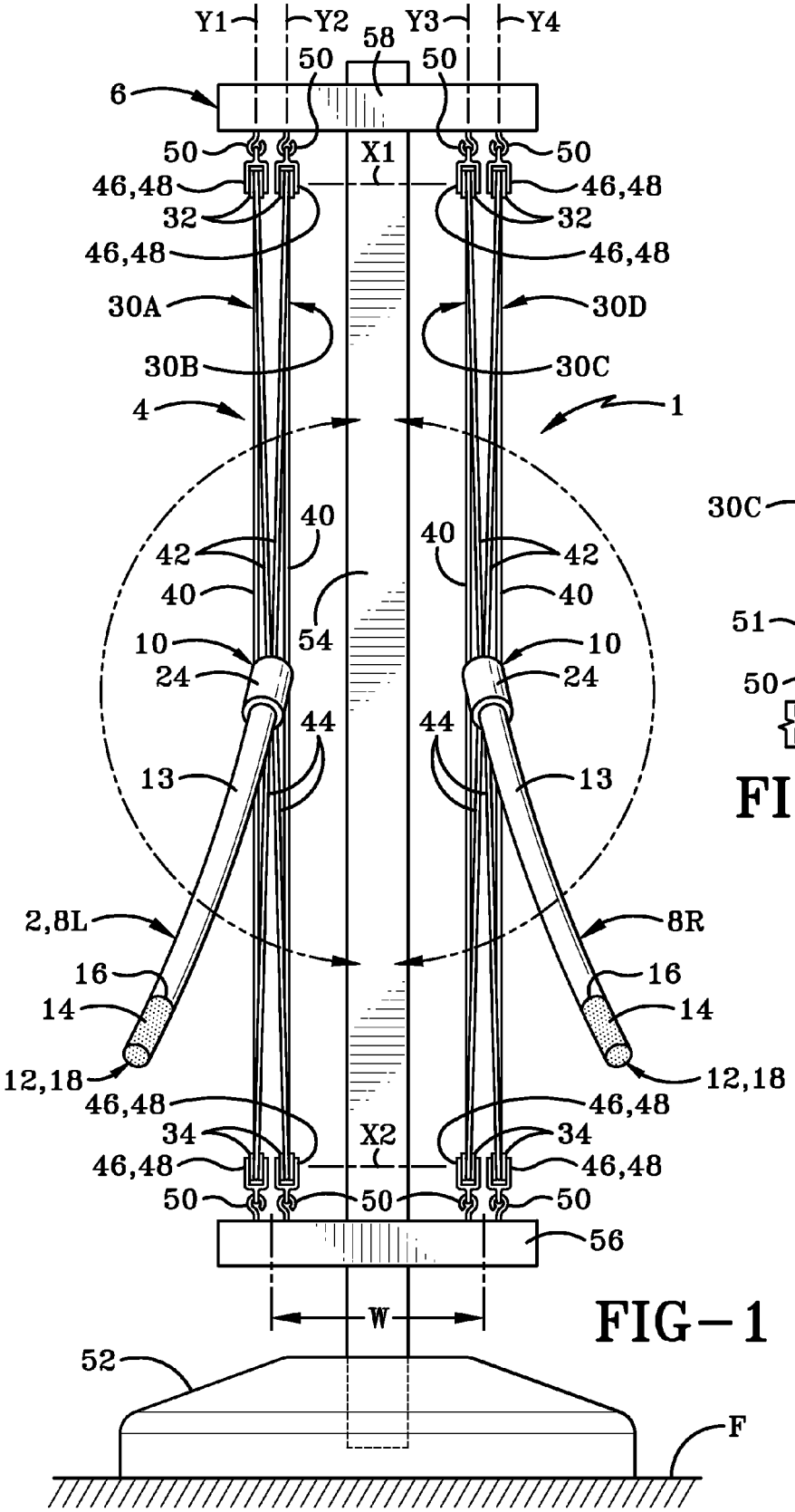
FIG. 1 is a front elevation view of a sample embodiment of the exercise device.

A first sample exercise device is shown generally at 1 in FIG. 1. Device 1 may include an undulation assembly 2, a shock-absorbing assembly 4, and a frame 6. Device 1 is generally configured to allow a person to exercise by undulating the undulation assembly 2, as described in greater detail further below. Undulation assembly 2 may include a pair of flexible elongated undulation members 8 which are spaced from another and generally adjacent one another. In the sample embodiment, members 8 are designated first and second or left and right elongated undulation members 8L and 8R which may be substantially identical to one another. Each member 8 has a first or inner terminal end 10 and a second or outer opposed terminal end 12. Each member 8 is elongated between ends 10 and 12, which define therebetween a length L1 (FIG. 2) of member 8. Length L1 may be in a range of about 1 to 6 or 7 feet, and usually is in a range of 2 to 3, 4 or 5 feet. Member 8 has an annular outer surface 13 which extends from first end 10 to second end 12. Member 8 is formed of a flexible material and may be in the form of a piece of rope, for instance, a piece of manila rope, a polyester/polyethylene rope, a polypropylene rope, a polydac rope (i.e., a polyester/polypropylene blend rope), a danline rope (i.e., a polypropylene/polyethylene rope), a nylon rope or any other suitable rope known in the art. Rope 8 may thus be formed of natural fibers or manmade fibers including various plastic materials, which are often thermoplastic materials. Rope 8 may also, for example, be formed of or include a piece of flexible tubing, such as elastomeric tubing which may be filled with particulate material or a liquid. One suitable particulate filled elastomeric tubing is sold under the name HEAVYROPE®. Outer surface 13 is generally cylindrical although it will be understood that this may be a broad description given the various types of materials which may form member 8, such as the ropes noted above. The rope typically has an outer diameter D (FIG. 2) in a range of about 1.0 or 1.5 to 2.0, 2.5 or 3.0 inches. In the sample embodiment, outer diameter D is generally constant from end 10 to end 12 of rope 8. In the sample embodiment, member 8 and the rope are formed as a single piece of rope which does not form a closed loop and which does not branch (for example, to form a Y-shaped configuration etc.) although such configurations may also be used.

Undulation assembly 2 may include a handle 14 which may be secured to undulation member/rope 8 adjacent outer end 12 and which may serve as a gripping location distal inner portion or end 10. In normal use, the user of device 1 may also grip rope 8 at another gripping location which may be further from outer end 12 than handle 14, yet still distal inner end 10. Handle 14 may be formed of a plastic material and may be a shrink wrap handle which is applied to rope 8 adjacent outer end 12 and allowed to cool to shrink onto rope 8 to form the shrink wrap handle which is tightly secured along end 12 such that handle 12 will not typically be removable from rope 8. Handle 14 secured the ends of the fibers forming rope 8 to prevent fraying of the rope. A shrink wrap binder similar to handle 14 may also be secured to rope 8 along inner end 10 to likewise prevent fraying of the rope along inner end 10. Handle 14 has inner and outer ends 16 and 18 defining therebetween a length L2 (FIG. 2) which is substantially less than length L1. Length L2 of handle 14 is usually in a range of about 3 or 4 to 5 or 6 inches although this may vary. The above-noted range of outer diameter D of rope 8 may also apply to the outer diameter of handle 14. Other suitable types of handles may be used, some of which are discussed further below. In addition, undulation member 8 may be formed such that the handle is simply a portion outer surface 13 of rope 8 adjacent outer end 12 and distal inner end 10. In such a case, the rope may be secured against fraying by, for example, a short end cap or, where the fibers are formed of a thermoplastic material, by melting the ends of the rope fibers and allowing the melted ends to cool to solidify into one or more solid end pieces.

Undulation assembly 2 may also include an inner end mounting structure such as a rigid cup-shaped end cap 20 (FIG. 2) which is secured to undulation member/rope 8 adjacent inner end 10 and an inner end linkage which may include a link 22 such that cap 20 and link 22 define a closed loop defining a through hole or passage therebetween. End cap 20 may be secured to rope 8 by pins which pass through an annular sidewall of end cap 20 and through rope 8. End cap 20 and link 22 are typically formed of metal although other rigid materials may be used such as certain rigid durable plastic materials. An outer layer (formed of, for instance, rubber or another elastomer) may encase the metal or plastic forming link 22 to minimize noise during operation of device 1.

Undulation assembly 2 may further include a weight member 24 which may be secured to rope 8 adjacent inner end 10. Weight member 24 has inner and outer ends 26 and 28 defining therebetween a weight member length L3 which is usually in a range of about 1 or 2 to 5 or 6 inches although this may vary. Generally, where weight member 24 is used, it is in its entirety adjacent inner end 10 of rope 8. Weight member has a weight which is usually at least 1 or 2 pounds and is typically in a range of about 1 to 6 pounds although this may also vary. Weights or weight members may be positioned elsewhere, such as adjacent outer end 12 or intermediate ends 10 and 12, and may be inside or outside of rope 8, as discussed further below with respect to various figures. Weight member 24 and other weight members discussed herein are usually distinct from the material or materials of which undulation member or rope 8 is formed. Weight member 24 may include or be formed entirely of metal. Weight member 24 may also be formed as a sand weight which may include an outer shell defining an interior chamber containing sand or another solid granular or particulate material which typically makes up the majority of the weight of member 24 when in the form of a sand weight. The outer shell may be formed of a rigid or flexible material. Some sand weights or the like are formed largely of a woven flexible outer shell containing the sand or particulate material, and may include a fastener for removably securing the weight member on rope 8, such as a buckle or hook and loop fastener, so that the weight member may be secured to or separated from rope 8. Elastic or non-elastic straps may also surround the outer shell to secure the weight member to rope 8. Various other fasteners may be used for this purpose, as will be understood by one skilled in the art. Weight member 24 may also be formed as a sleeve which is slid over rope 8 and secured by any suitable fastener.

As noted above, an undulation member may have a closed loop configuration, such that an inner portion of the closed loop (analogous to inner portion or terminal end 10) is operatively connected to the shock-absorbing assembly via suitable links similar to those described above. The gripping location on such a closed loop undulation member would thus remain distal the inner portion of the loop, any connecting links adjacent the inner portion and the elastic line/travel line. An undulation member may also, for example, have a Y-shaped configuration such that the "bottom" of the Y may serve as the inner end or portion of the undulation member, while the forks of the Y may provide gripping locations for two hands distal the inner portion of the Y-shaped undulation member, any connecting links adjacent the inner portion and the elastic line/travel line. An undulation member may also, for example, have a U-shaped configuration such that the "bottom" or base of the U may serve as the inner end or portion of the undulation member, while the uprights or ends of the U may provide gripping locations for two hands distal the inner portion of the U-shaped undulation member, any connecting links adjacent the inner portion and the elastic line/travel line. Thus, as with the various other embodiments, the gripping location distal the inner end or portion of the undulation member, any connecting links adjacent the inner portion (such as link 22) and the elastic line/travel line.

Shock-absorbing assembly 4 may include one or more flexible lines 30, which are denoted in the sample embodiment from left to right in FIG. 1 as lines 30A, 30B, 30C and 30D, which are usually substantially identical to one another although this may vary. In device 1, lines 30 are elastic lines whereby device 1 illustrates the use of first, second, third and fourth elastic lines. Each line 30 typically has an outer diameter in a range of about ¼ to ⅝ inch although this may vary somewhat. In the sample embodiment, the outer diameter of each line 30 is generally constant from end 36 to end 38, or along its entire length. Each line 30 wraps around a respective rotatable upper pulley wheel or sheave 32 and a respective rotatable lower pulley wheel or sheave 34 and is connected to link 22 to form a closed loop. Alternately, other closed loop configurations may be used, such as a closed loop which includes line 30 or is formed entirely by an elastic line and is wrapped around sheaves 32 and 34. Upper sheaves 32 are rotatable about a common axis X1 which is horizontal in the sample embodiment although this may vary. Likewise, lower sheaves 34 are rotatable about a common axis X2, which is typically parallel to axis X1 and horizontal in the sample embodiment although this may vary. In the sample embodiment, the one or more lines 30 serve as the sole or major shock-absorbing component(s) of assembly 4. Each line 30 has first and second terminal ends 36 and 38 which in the sample embodiment are end loops which loop around link 22 such that a portion of each end loop passes through the through hole defined by link 22 and a portion of link 22 passes through the respective through holes formed by each end loop 36, 38, whereby ends 36 and 38 are secured to link 22. Each line 30 includes a rear segment 40 which extends from the back of one of upper sheaves 32 downwardly to the back of one of lower sheaves 34, a first or upper front segment 42 which extends downwardly from the front of the corresponding upper sheave 32 to link 22, and a second or lower front segment 44 which extends upwardly from the front of the corresponding lower sheave 34 to link 22. Although line 30 is shown as having two terminal ends serving as a connection point for connecting to link 22, line 30 may be formed as a closed or endless loop which may have a link or other connector built in or formed integrally as part of the endless line. Thus, each line 30 has a connection point where another component such as undulation member 8 may be connected, wherein the connection point may include a link connected to terminal ends or to a line 30 having no terminal ends. Upper segment 42 extends from adjacent inner end 10 of member 8 to upper sheave 32 and lower segment 44 extends from adjacent inner end 10 to lower sheave 34. Upper segment 42 also extends from adjacent a first point (e.g., a point adjacent end 36, link 22 or the like) along elastic line 30 to upper sheave 32 and lower segment 44 extends from adjacent the first point to lower sheave 34.

Figure 2:
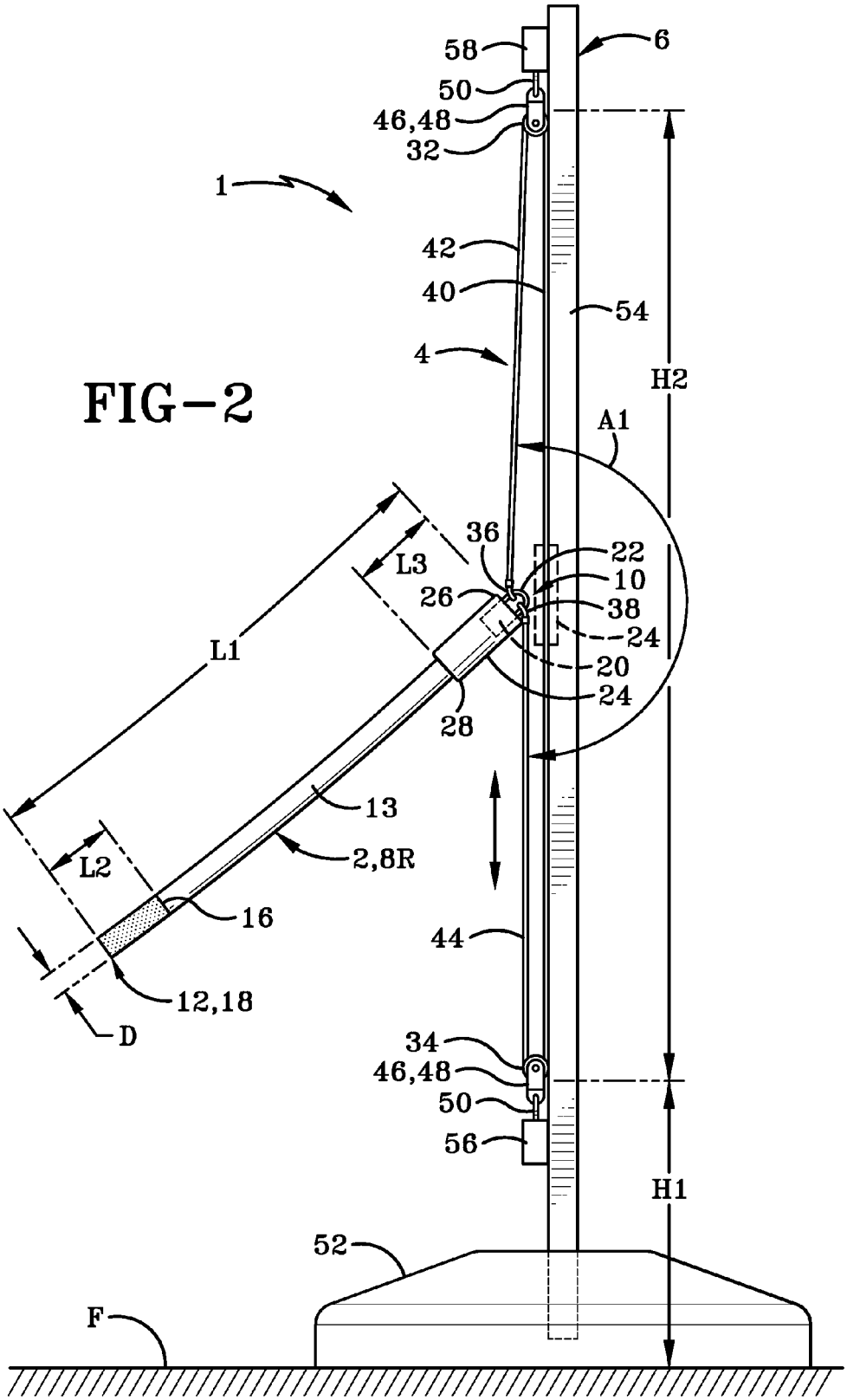
FIG. 2 is a side elevation view of the device of FIG. 1 shown from the right side.

In the resting or home position of lines 30 shown in FIGS. 1 and 2, each of segments 40, 42 and 44 is substantially vertical and parallel or nearly parallel. As shown in FIG. 1, upper front segment 42 of line 30A angles slightly to the right in the downward direction from the upper end of said segment 42 and the associated upper sheave 32 to the lower end of said segment 42 and the associated link 22, whereas upper front segment 42 of line 30B angles slightly to the left in the downward direction from the upper end of said segment 42 and the associated upper sheave 32 to the lower end of said segment 42 and the associated link 22. Likewise, upper front segment 42 of line 30C angles slightly to the right in the downward direction from the upper end of said segment 42 and the associated upper sheave 32 to the lower end of said segment 42 and the associated link 22, whereas upper front segment 42 of line 30D angles slightly to the left in the downward direction from the upper end of said segment 42 and the associated upper sheave 32 to the lower end of said segment 42 and the associated link 22. Inner end 10 of left undulation member 8L via link 22 is connected to shock-absorbing assembly 4 adjacent the ends 36 and 38 of elastic lines 30A and 30B, whereas inner end 10 of right undulation member 8R via link 22 is connected to shock-absorbing assembly 4 adjacent the ends 36 and 38 of elastic lines 30C and 30D.

Referring to FIG. 2, in the resting or home position of lines 30, upper front segment 42 of each line 30 angles slightly forward in the downward direction from the upper end of said segment 42 and the associated upper sheave 32 to the lower end of said segment 42 and the associated link 22, whereas the lower front segment 44 of each line 30 angles slightly forward in the upward direction from the lower end of said segment 44 and the associated lower sheave 34 to the upper end of said segment 44 and the associated link 22. Each of segments 42 and 44 in the home position are typically within 5, 10, 15 or 20 degrees of vertical. Segments 42 and 44 in the home position also define therebetween an angle which is typically within a range of 160, 165, 170 or 175 degrees to 180 degrees.

As noted above, weight members 24 may be positioned at various locations. For example, as shown in FIG. 2, a weight member 24 (dashed lines) may be secured to one or more of the travel lines 30. FIG. 2 shows weight member 24 secured to rear segment 44 such that member 24 is about midway between upper and lower sheaves 32 and 34 when device 1 is in the home position with ends 36, 38, link 22 and inner end 26 about midway between upper and lower sheaves 32 and 34. When weight member 24 is secured in this manner, member 24 will move with travel line 30 as line 30 moves, in response to undulation of the corresponding undulation member 8.

Assembly 4 includes eight pulleys 46 each including a pulley housing 48 on which each respective sheave 32, 34 is rotatably mounted about the respective axes X1 and X2 as noted above. Pulleys 46 include four upper pulleys and four lower pulleys each of which is mounted on frame 6 by a pulley mount 50. Each mount 50 is shown as a hook which may be screwed into frame 6. However, any suitable pulley mount may be used. As noted above, each of sheaves 32, 34 is rotatable about a respective substantially horizontal axis. Each pulley 46 is pivotally mounted on a respective mount 50 so that a given pulley 46 (including housing 48 and the corresponding sheave) is pivotable back and forth relative to the corresponding mount 50 and frame 6 about a respective substantially vertical axis. In particular, the pulleys 46 from left to right are respectively pivotable about four different parallel vertical axes Y1, Y2, Y3 and Y4, which are offset from one another, typically lie within a common plane, and which are different from and usually substantially perpendicular to axes X1 and X2.

Figure 1A:
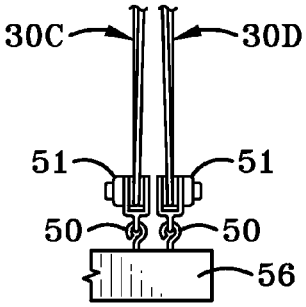
FIG. 1A is a front elevation view of a portion of a modified exercise device showing a resistance device for resisting travel of the travel line.

Turning briefly to FIG. 1A, it is seen that a resistance mechanism 51, which may be used in addition to or instead of one or more weight members 24, may include a friction member which frictionally engages the first sheave during rotation thereof to create resistance to rotation of the first sheave while the first sheave rotates, or a magnet which provides a magnetic field to create resistance to rotation of the first sheave while the first sheave rotates. The use of a magnet generally provides a configuration which during operation is quieter than the friction member.

Frame 6 includes various frame members including a base 52 configured to sit on a floor F, an upright 54 secured to and extending upwardly from base 52, and lower and upper crossbars 56 and 58 secured respectively to upright 54. Base 52 may simply be seated on floor F or may additionally be secured to floor F by any suitable type of fastener. Where, for example, fasteners which would extend into the floor are not used, base 52 may be sufficiently heavy so that frame 6 is a freestanding component capable of remaining stationary throughout the various forces that are applied on device 1 during use. Base 52 may be formed largely of metal to provide such weight. Alternately base 52 may define an interior chamber filled with water, sand or other particulate material to provide sufficient weight. Moreover, base 52 may be configured with pegs which extend upwardly such that barbell weights having holes formed therein may be mounted on the pegs with the pegs in the barbell holes to provide sufficient weight. Another possibility is the placement of separate and removable sand weights or the like on base 52 or on part of frame 6. Sand weights or other types of sufficiently heavy objects/weights may also be positioned such that one or more of the pulleys is mounted on the weight—such a configuration may, for example, include the one or more pulleys being removably mounted on such a weight. Other possibilities for providing sufficient weight to base 52 will be readily understood by one skilled in the art.

Upright 54 is fixedly secured adjacent its bottom end to base 52 and extends upwardly to a top end. Upright 54 is upwardly elongated and usually substantially vertical. Lower crossbar 56 is fixedly secured to upright 54 adjacent the lower end of upright 54 and spaced upwardly from floor F and the bottom of base 52 so that the bottom of lower sheaves 34 are a vertical distance or height H1 above floor F and the bottom of base 52. Upper crossbar 58 is fixedly secured to upright 54 adjacent the top end of upright 54 and spaced upwardly from floor F, the bottom of base 52 and lower crossbar 56 so that the top of upper sheaves 32 are a vertical distance or height H2 above the bottom of lower sheaves 34 and a vertical distance or height H1 plus H2 above floor F and the bottom of base 52. Height H1 may be in a range of about 4-18 inches and typically about 12 inches although this may vary. Height H2 may be in a range of about 45-80 inches and typically about 55-65 inches although this may vary. Height H1 plus H2 may be in a range of about 48-96 inches and typically about 68-78 inches although this may vary.

Frame 6 shows one configuration of a frame on which shock-absorbing assembly 4 may be mounted, although many different frame configurations may be used. For example, a rigid frame may be formed which is secured to the ceiling, an I-beam or another fixed overhead structure. Alternately, device 1 may use a frame which is secured to a wall without being seated on a floor. Upright 54 may, for example, represent a wall on which crossbars 56 and 58 are secured, and wherein base 52 is not used. Assembly 4 may also be secured to existing exercise machine frames, or may be mounted on a frame having a base or standing platform on which the user may stand to help stabilize the frame. Assembly 4 may also be secured to a door or door frame. In short, frame 6 may generally be any substantially stationary structure on which assemblies 2 and 4 may be mounted. Although the frame is typically stationary during use, a frame may, for example, be mounted on wheels to provide portability to the exercise device when movement of the device is desired. Also, a rotatable frame such as a frame which is rotatable about a vertical axis may be used to allow a user to move laterally during use of the exercise device. Other frames which move laterally, forward, or back may be provided to respectively allow the user to move laterally, forward or backward while using the exercise device. It should thus be clear that any suitable frame or mounting structure may be used.

The operation or use of exercise device 1 is now described with primary reference to FIGS. 3-10. Generally, FIGS. 3-6 illustrate the back and forth or up and down movement of left and right hands LH and RH to respectively move the left undulation member 8L and right undulation member 8R upwardly and downwardly and to cause undulation or undulating movement of members 8L and 8R. The undulation of each member 8 typically occurs along the full length of the given member 8. Each undulation member/assembly is operatively connected to one of the shock absorbing assemblies, whereby movement of undulation member/assembly causes movement of the shock absorbing assembly and vice versa.

Figure 3:
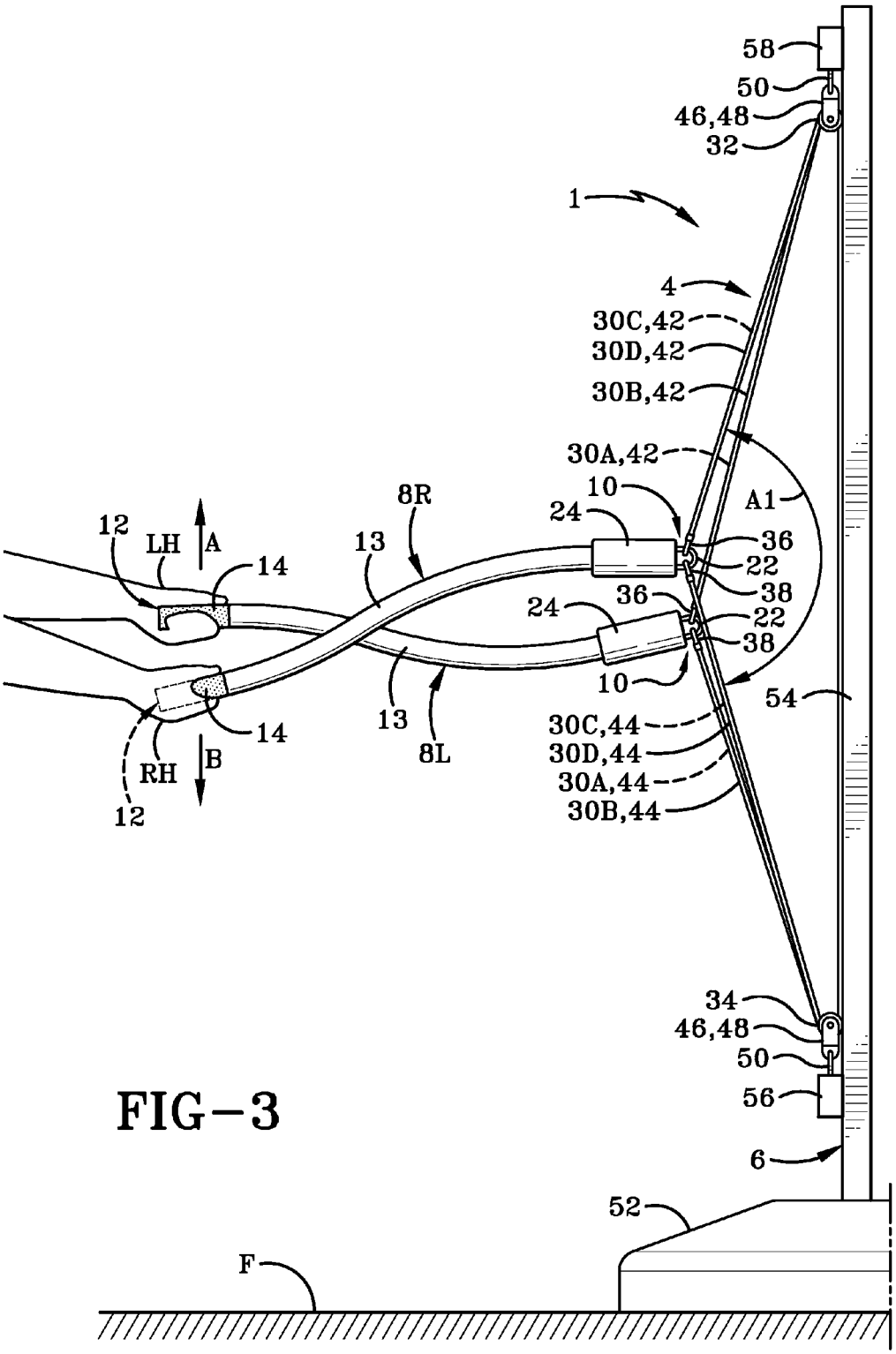
FIG. 3 is similar to FIG. 2 and shows a stage of operation of the device.

Although various types of exercises may be performed with exercise device 1, the first exercise described is the movement of left and right hands LH and RH upwardly and downwardly generally in opposite directions simultaneously. As shown in FIG. 3, the user first grips the left and right undulating members 8L and 8R at respective gripping locations distal inner end 10, typically by grasping or gripping handles 14 of the respective undulation members. At the stage shown in FIG. 3 and while the user continues to grip handles 14, the left hand is moved upwardly (Arrow A) and the right hand RH is moved downwardly (Arrow B) whereby the left undulation member 8L is moved upwardly and the right member 8R is moved downwardly and each of the undulation members moves in an undulating motion. The upward movement of left undulation member 8L also includes the upward movement of outer end 12, inner end 10, weight member 24, link 22 and ends 36 and 38 of elastic lines 30A and 30D. This continued upward movement thus also causes the upward movement of the upper segments 42 of lines 30A and 30B, the upward movement of lower segments 44 of lines 30A and 30B, and the downward movement of segments 44 of lines 30A and 30B. This movement of lines 30A and 30B thus causes the rotation of upper sheaves 32 around which lines 30A and 30B are respectively wrapped and which said lines engage. This movement of lines 30A and 30B likewise causes the rotation of the lower sheaves 34 around which lines 30A and 30B are wrapped. In the sample embodiment, a given line 30 may be wrapped around a given upper and lower sheave to varying degrees, for instance about half way around when device 1 is in the home position, as shown in FIG. 2. The degree to which a line 30 is wrapped around a given sheave will vary somewhat depending on the specific operational configuration; thus, for example, generally the closer an undulating member is to a given sheave, the less the associated line 30 is wrapped around the given sheave. In the sample embodiment, a given line is only wrapped partially around a given sheave (typically half way around or less) although it is possible to wrap a line all the way around a given sheave or rotatable bar or the like.

During the upward movement of segments 42 and 44 of lines 30A and 30B and the downward movement of the corresponding lines 44, sheaves 32 and 34 rotate in a clockwise direction as viewed from the right side of device 1 (FIG. 2). During this upward movement of undulation member 8L and the corresponding movement of lines 30A and 30B and sheaves 32 and 34, the upper and lower pulleys 46 on which lines 30A and 30B are mounted may swivel or pivot back and forth about their pivotal mounting on pulley mounts 50. This swiveling or pivotal movement may continue throughout any of the various movements of the left undulation member 8L.

Meanwhile, the right hand RH is moving downward again as indicated at Arrow B, thereby causing the downward movement of right undulation member 8R and the undulating movement thereof, along with the downward movement of outer end 12, inner end 10, weight member 24 mounted on right member 8R, the corresponding link 22 and the ends 36 and 38 of lines 30C and 30D. Likewise, the downward movement of member 8R causes the downward movement of the upper and lower segments 42 and 44 of lines 30C and 30D, and the upward movement of segments 44 of lines 30C and 30D. This movement of lines 30C and 30D thus causes the rotation of the upper and lower sheaves 32 and 34 due to the frictional engagement between lines 30C and 30D and the corresponding sheaves around which they are wrapped whereby sheaves 32 and 34 rotate in a counterclockwise direction as viewed from the right of device 1. The upper and lower pulleys 46 may, during this movement, also swivel or pivot back and forth about the vertical axes via their pivotal movement on the corresponding pulley mounts 50.

Figure 4:
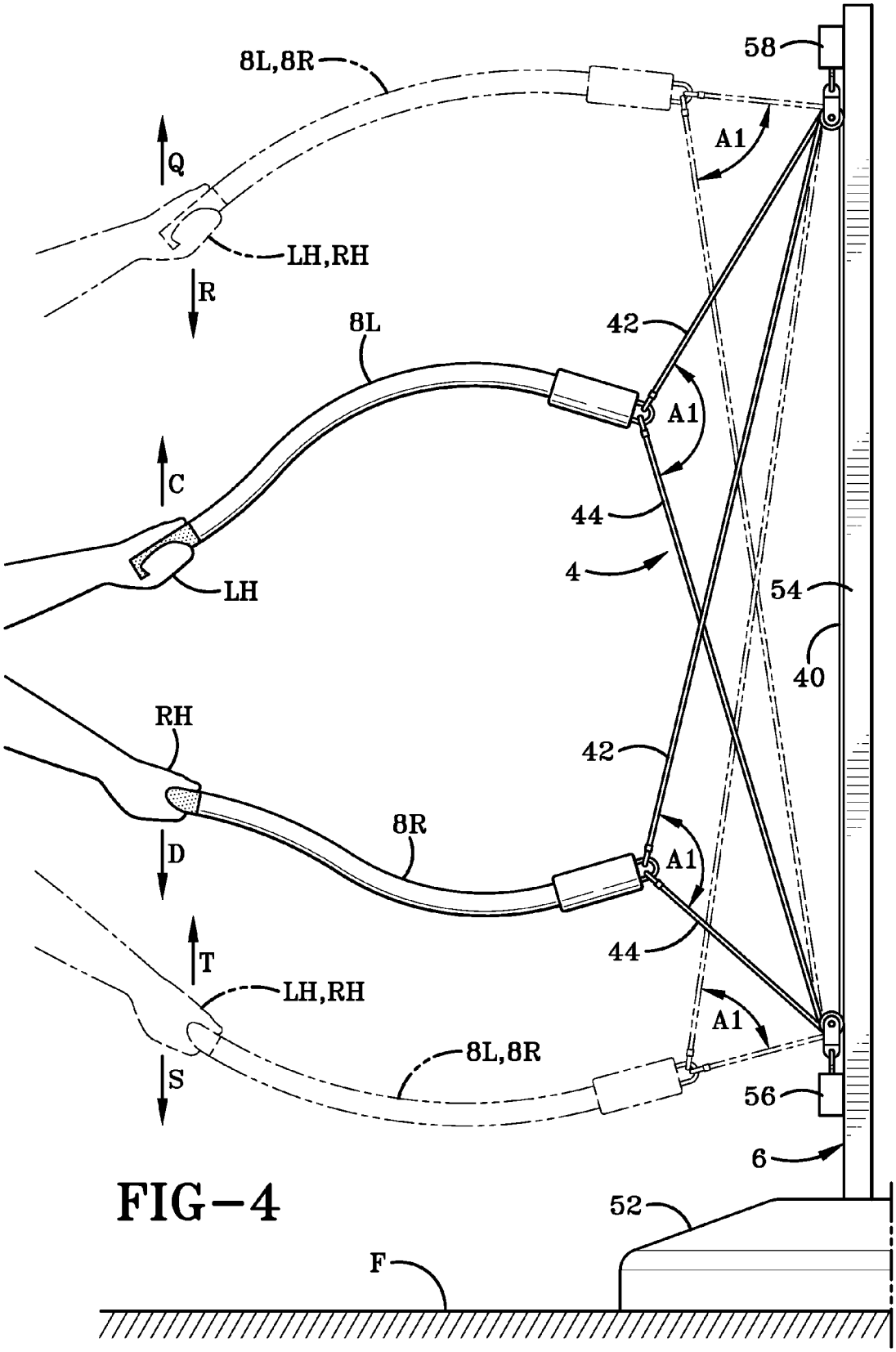
FIG. 4 is an additional operational view similar to FIG. 3 at a different stage of operation.

FIG. 4 illustrates in solid lines that left hand LH continues the upward movement (Arrow C) relative to the position shown in FIG. 3, while right hand RH continues the downward movement (Arrow D) relative to the position shown in FIG. 3. Thus, the general movement of each of undulation members 8L and 8R and the corresponding weights 24, links 22, the lines 30A-30D, sheaves 32 and 34 and the upper and lower pulleys 46 continues generally in the same manner as described with respect to the motion of FIG. 3. However, the continued upward movement of left hand LH and left member 8L as shown in FIG. 4 further illustrates the continued undulation movement of member 8L as well as the fact that segments 42 of lines 30A and 30B have gotten shorter than compared to the stage shown in FIG. 3, and the lower segments 44 of lines 30A and 30B have gotten longer than the stage shown in FIG. 3, whereas rear segments 40 remain substantially the same length during this movement and indeed throughout all of the various exercises described herein.

Meanwhile as shown in FIG. 4, right hand RH continues to move downwardly as shown at Arrow D such that right member 8R continues its pattern of undulating while the corresponding weight member 24 moves downwardly along with the corresponding link 22 and the corresponding ends 36 and 38 of lines 30C and 30D. In addition, this downward movement likewise continues the downward movement of the upper and lower segments 42 and 44 of lines 30C and 30D and the upward movement of segments 44 of lines 30C and 30D, along with the continued counter-clockwise rotation of sheaves 32 and 34 around which lines 30C and 30D are wrapped. Since the inner end 10, link 22 and ends 36 and 38 of lines 30C and 30D have moved further downward than the stage shown in FIG. 3, the lower segments 44 of lines 30C and 30D have gotten shorter compared to FIG. 3 and the upper segments 42 of lines 30C and 30D have gotten longer than shown in FIG. 3.

FIGS. 3 and 4 further illustrate part of the result of using stretchable elastic lines 30 during the exercises discussed herein. In FIG. 3, it will be noted that the upward and downward movement of undulation members 8L and 8R respectively translates in part to an outward force on the ends 36 and 38 of the respective lines 30A-30D whereby the inner ends 10, links 22, ends 36 and 38 and weight members 24 are positioned further forward of or further away from segments 44, sheaves 32 and 34, upright 54 and crossbars 56 and 58 than they are in the resting or home position shown in FIG. 2. In the resting position of FIG. 2, weight members 24, links 22, inner ends 10 and ends 36 and 38 are generally adjacent the corresponding rear segments 44 of a given line 30, and also generally adjacent upright 44. While FIG. 3 shows these various components further forward than in FIG. 2, FIG. 4 shows these components even further forward than in FIG. 3. More particularly, FIG. 4 illustrates that at the stage shown, wherein the left weight member 24 and inner end 10 of left undulation member 8L are higher than the generally central position shown in FIG. 3, the weight member 24 on member 8L, link 22, ends 36 and 38 of lines 30A and 30B are all further forward than they are at the stage shown in FIG. 3. Similarly, FIG. 4 shows, that the right weight member 24, the inner end of right member 8R, the right link 22 and the ends 36 and 38 of the right lines 30C and 30D are further forward than they are in the stage shown at FIG. 3. As the left and right hands and left and right undulating members 8L and 8R move upwardly and downwardly throughout the various exercises, this distance typically continuously varies in that the force applied by the left and right hands to undulation members 8L and 8R is translated in a manner which pulls or stretches the lines 30A-30D generally outwardly or forward away from the back of device 1 while also causing the various other movements described above and to be described below as well. Thus, the user moves his or her hand in a back and forth manner to cause undulation of undulation member being gripped, thereby causing elastic line 30 to stretch and contract, which is true of all embodiments. (The description of the operation illustrated by dashed lines in FIG. 4 is provided further below.)

Figure 5:
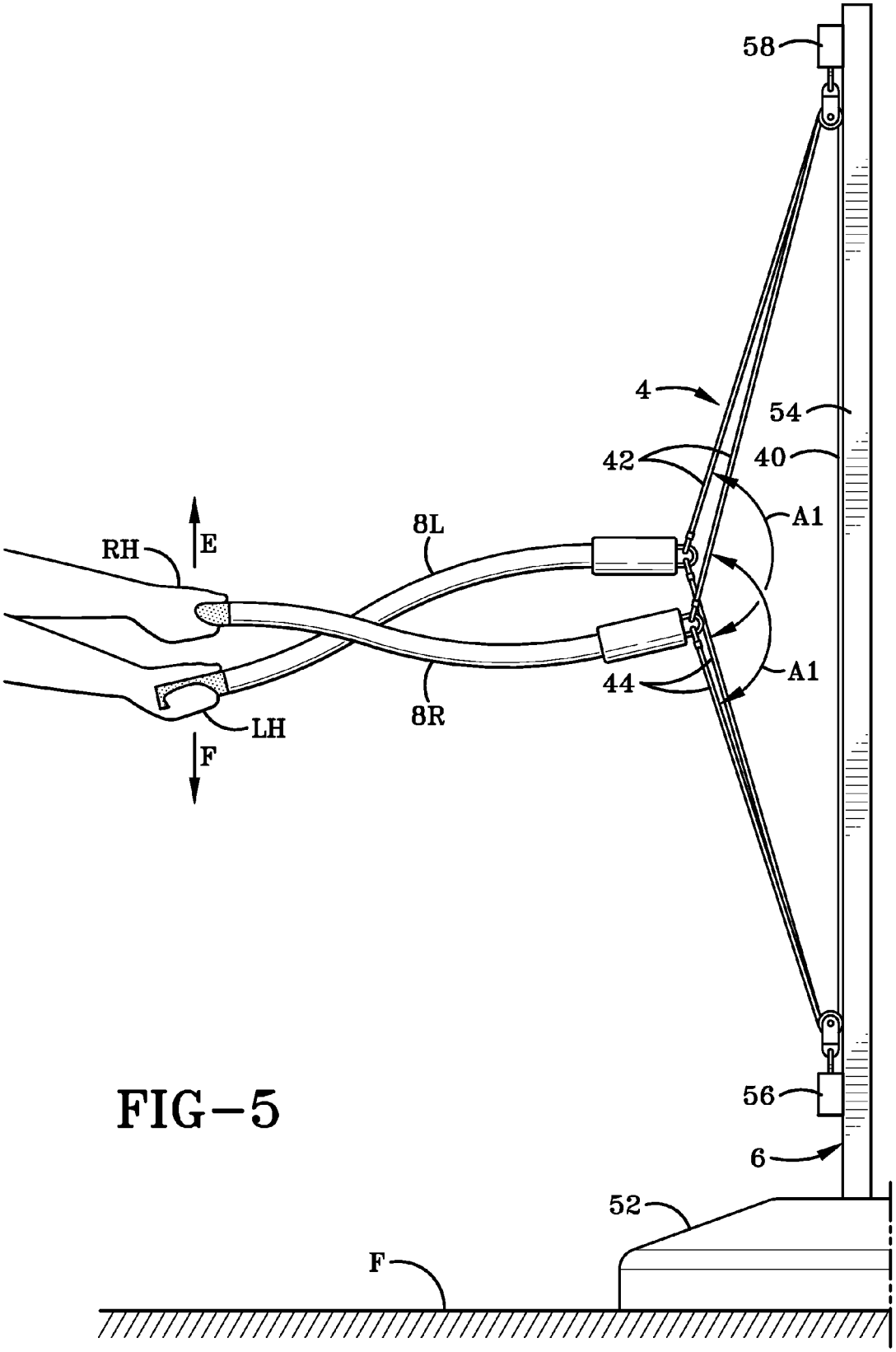
FIG. 5 is similar to FIG. 4 and shows a different stage of operation of the device.

FIG. 5 illustrates a stage which is subsequent to that shown in FIG. 4, wherein the right hand has stopped moving downwardly and is moved back upwardly as indicated at Arrow E to move the right undulation member 8R upwardly, and the left hand LH has ceased to move upwardly and has begun to move downwardly as indicated at Arrow F to move undulation member 8L therewith. Looking back at FIG. 3, the undulation members 8L and 8R may be seen to intersect or overlap as viewed from the right side of the device, whereas in FIG. 4 members 8L and 8R do not overlap as viewed from the right side, and in FIG. 5 they once again overlap as viewed from the side except that the right member 8R is now moving upwardly and left member 8L is moving downwardly instead of in the opposite directions shown in FIG. 3. In FIG. 3, the right weight 24 is somewhat higher than the left weight 24, whereas the left weight 24 is substantially higher than the right weight 24 in FIG. 4, and the left weight 24 is generally adjacent and somewhat higher than the right weight 24 in FIG. 5. Inasmuch as FIG. 5 illustrates the opposite movement of the left and right hands and the left and right members 8L and 8R from that shown in FIGS. 3 and 4, the various components are generally moving in the opposite direction. Thus, left hand LH and left member 8L are moving downwardly along with the left weight 24, the inner end 10 of member 8L, the left link 22, ends 36 and 38 of lines 30A and 30D and the upper and lower segments 42 and 44 of lines 30A and 30B, while the rear segments 40 of lines 30A and 30B move upwardly and the upper and lower sheaves 32 and 34 on which lines 30A and 30B are mounted rotate in the counter-clockwise direction as viewed from the right side. The left weight 24, left link 22 and ends 36 and 38 of lines 30A and 30B have also moved further rearward relative to the position shown in Fig, 4, and generally adjacent to that shown in FIG. 3.

Meanwhile, the right hand in FIG. 5 is moving upward as shown at Arrow E, thereby causing the upward movement of right member 8R and the continued undulating movement thereof, along with the upward movement of right weight 24, right link 22 and ends 36 and 38 of lines 30C and 30D, and the upper and lower segments 42 and 44 of lines 30C and 30D, along with the downward movement of rear segments 40 of lines 30C and 30D and the clockwise rotational movement as viewed from the right side of the upper and lower sheaves 32 and 34 which are engaged by lines 30C and 30D.

Figure 6:
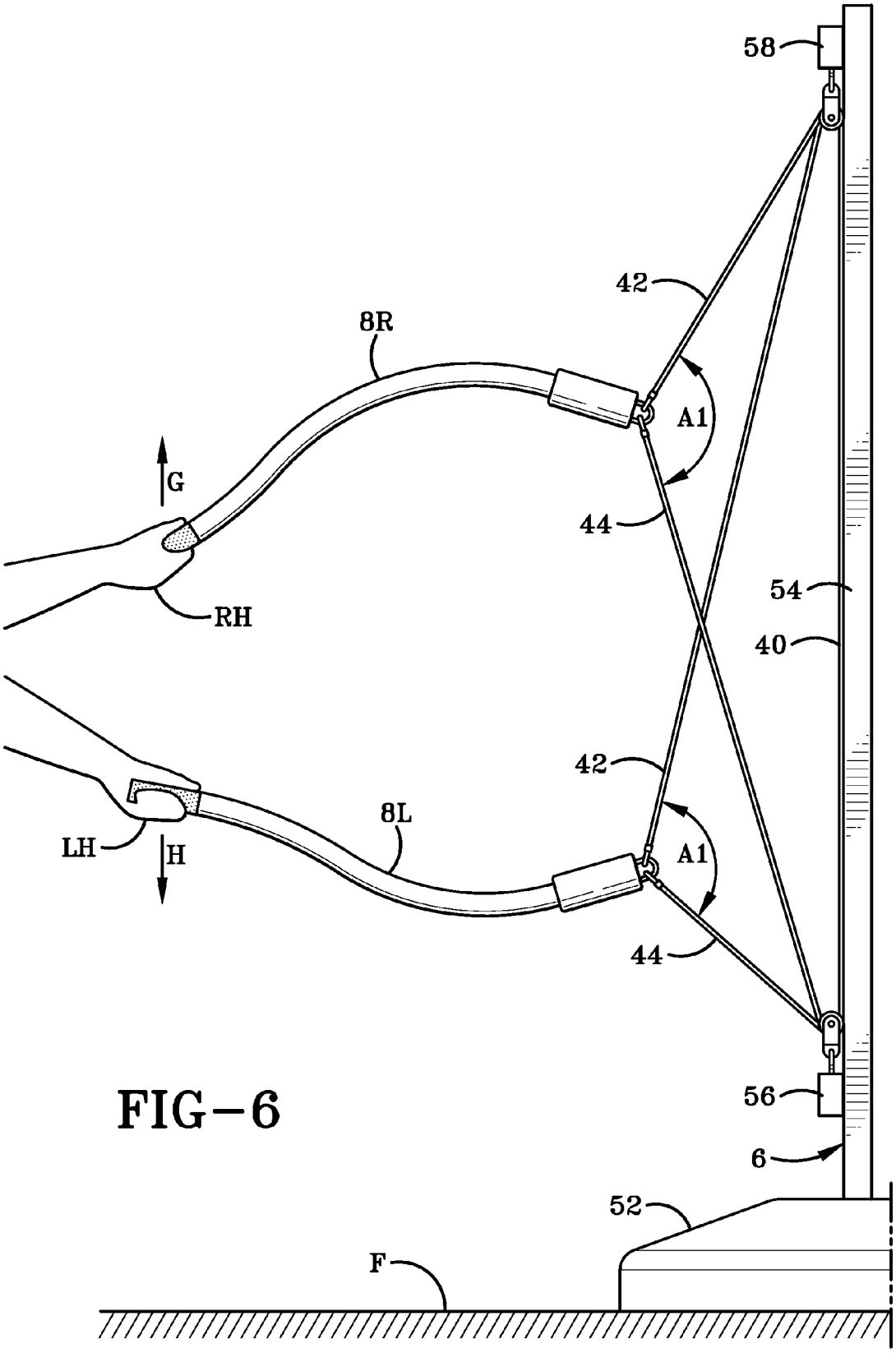
FIG. 6 is similar to FIG. 5 and shows an additional stage of the operation of the device.

FIG. 6 shows the continued upward movement of right hand RH at Arrow G and the continued downward movement of left hand LH at Arrow H relative to the position shown in FIG. 5. This continued or upward movement of right hand RH thus provides continued upward movement of right member 8R and the various associated components including the right weight member 24, right link 22, ends 36 and 38 of lines 30C and 30D, and the upper and lower segments 42 and 44 of lines 30C and 30D, along with the downward movement of rear segments 40 of lines 30C and 30D and the clockwise rotational movement as viewed from the right side of the sheaves 32 and 34 which are engaged by lines 30C and 30D. Likewise, the continued or further downward movement of left hand as shown at Arrow H drives the continued downward movement of left undulation member 8L and the corresponding components associated therewith, such as the left weight 24, left link 22, ends 36 and 38 of left lines 30A and 30B and the upper and lower segments 42 and 44 of lines 30A and 30B, along with the upward movement of rear segments 40 of lines 30A and 30B and the counter-clockwise rotational movement as viewed from the right side of the upper and lower sheaves 32 and 34 which are engaged by fines 30A and 30B. Thus, the user may continue the opposing upward and downward movement of the left and right hands as shown in FIGS. 3-6 in a repeated manner, thereby repeating the various movements described above. The various Arrows A-H in FIGS. 3-6 also represent forces applied by the hands in the upward or downward directions accordingly to move the undulation members and other components as described above. Thus, the user of exercise device 1 is generally applying force via the left and right hands to undulation members in an up or down direction which is generally perpendicular to the length of the undulation members or ropes 8. The application of this force thus causes the undulating movement of members 8, as well as the up and down back and forth movement of the various components adjacent their ends 10 of members 8, as well as the forward and rearward back and forth movement of the various components adjacent inner ends 10, including weight members 24, links 22 and the ends 36 and 38 of the various lines 30. This forward and rearward movement may also be described as moving these various components adjacent inner ends 10 generally toward and away from the user and the device. It is noted that the stretchable elastic lines 30 in the sample embodiment shown in FIGS. 1-6 provides a substantial amount of shock absorbency or dampening effect which prevents a jerking or jarring type of impact on the user's hands, wrists, elbows and body generally especially during the transition of the downward to upward movement of weight members 24 or the transition of the upward to downward movement of a given weight 24. Throughout the up and down movement of the left and right undulation members 8, the inner ends 10 thereof move back and forth in the up and down directions, such that inner ends 10, link 22 and ends 36 and 38 change height in a continual manner other than the momentary pause as each of these components changes direction from up to down or from down to up.

From the above description, we can see that a first or left hand may move in a first direction while a second or right hand is moving in a second opposite direction and then that the first or left hand may move in the second direction while the second or right hand is moving in the first direction. This type of movement thus causes corresponding movement of various other corresponding components. That is, during such movement of the hands, movement of the first hand in the first direction causes the undulation member 8 gripped by the first hand, the corresponding link 22, ends 36 and 38, and segments 42 and 44 to move in the first direction, while movement of the second hand in the second direction causes the undulation member 8 gripped by the second hand, the corresponding link 22, ends 36 and 38, and segments 42 and 44 to move in the second direction, followed by the reverse movement, that is movement of the first hand in the second direction causes the undulation member 8 gripped by the first hand, the corresponding link 22, ends 36 and 38, and segments 42 and 44 to move in the second direction, while movement of the second hand in the first direction causes the undulation member 8 gripped by the second hand, the corresponding link 22, ends 36 and 38, and segments 42 and 44 to move in the first direction.

The pivoting movement of pulleys 46 about the respective axes Y1-Y4 may be caused by the up and down back and forth movement of the left and right hands and the resulting undulation of members 8 and travel of lines 30, or for instance, may be caused by the user moving to the left and right, such as by sidesteps of the user's feet while continuing to grip (and undulate) the undulation members 8. This pivotal movement of pulleys 46 may also be caused by lateral or side to side (left to right and/or right to left) movement of the hands, undulation members 8 and lines 30, as in some of the exercises described further below.

FIGS. 2-6, show angles A1 which are defined between the upper and lower segments 42 and 44 of a given line 30 at a given time, as viewed from the side of device 1 in a direction generally parallel to axes X1 and X2. With reference to FIG. 2, angle A1 in the home or resting position is typically within a range of 170 or 175 to 180 degrees. FIGS. 3-6 show various different operational positions of the exercise device in which upper and lower segments 42 and 44 of a given line 30 at a given time vary. At any given point in time or operational position, that is, during the undulation of one or more undulation member 8, angle A1 is typically within a range of 80 or 90 to 140 or 150 degrees, and is most often an obtuse angle no more than about 150 degrees. During the exercise in which the user's left and right hands and the undulation members are moving up and down simultaneously in opposite directions, angle A1 is most often within the range of about 120 to 150 degrees although this may vary. Other exercises, such as when the left and right hands and undulation members are moving simultaneously up and down, angle A1 often reaches smaller angle values while of course moving through a range of values.

Figure 7:
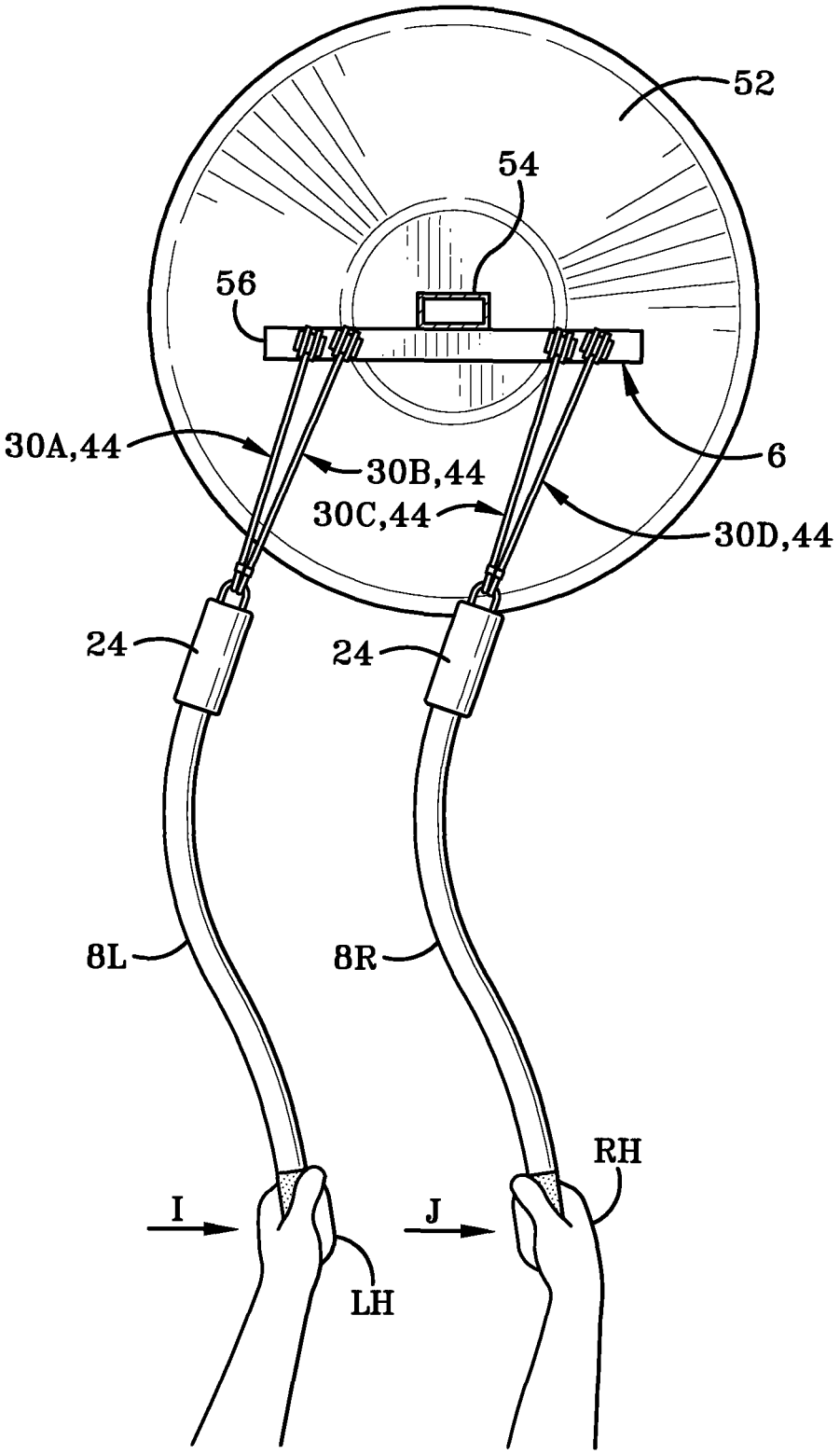
FIG. 7 is a sectional view shown from above providing another operational view of the device.
Figure 8:
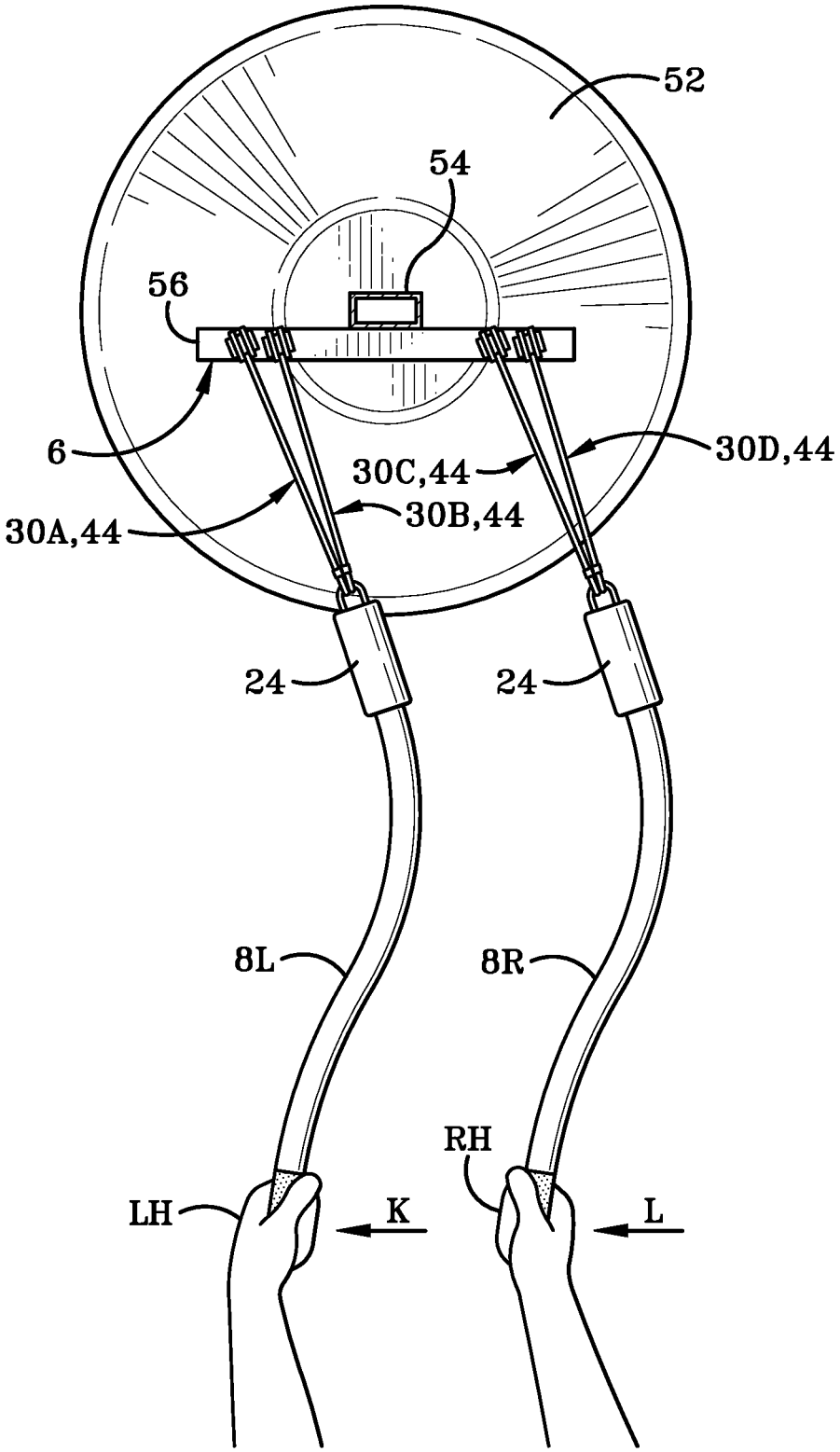
FIG. 8 is similar to FIG. 7 and shows an additional stage of the operation of the device of FIGS. 1-6.

With primary reference to FIGS. 7-10, it can be seen that device 1 is configured to also allow for the lateral and usually generally horizontal undulating movement of undulation members 8L and 8R, which is thus substantially perpendicular to the up and down movement or direction of the hands and undulation members described above. The user may transition between the generally vertical and generally horizontal movement of the hands and undulation members so that one occurs before or after the other. FIGS. 7 and 8 illustrate lateral or horizontal movement of the left and right hands in unison and accordingly the lateral and generally horizontal movement of undulation members 8L and 8R generally in unison. More particularly, FIG. 7 shows the left hand moving to the right at Arrow I and the right hand moving to the right at Arrow J generally in unison with one another (or in the same direction simultaneously) to cause undulating movement of members 8 and to generally move the outer ends 12 to the right, followed by the rightward movement of the inner ends 10 and the corresponding components such as the weights 24, links 22, ends 36 and 38 of lines 30A-30D, and the upper and lower segments 42 and 44 of lines 30A-30D. In FIG. 7, the upper and lower segments 42 and 44 are shown angled forward and to the left, having been stretched in that direction and beginning to return toward the right as a result of the rightward movement of the left and right hands and undulation members 8. In addition, FIG. 7 shows the pulleys 46 swiveled to the left in a clockwise direction as viewed from above to some degree relative to the home position of FIGS. 1 and 2. This swiveling to the left is also generally clockwise relative to the positions normally seen in FIGS. 3-6 wherein the primary movement of the hands is essentially vertically up and down although there may be variations in terms of up and down and lateral movement of the hands and undulation members.

FIG. 8 shows that the undulation members 8L and 8R have moved to the right along with the inner ends and various associated components including the upper and lower segments 42 and 44 and the various lines 30A-30D, while the left and right hands are shown moving to the left at Arrows K and L to continue the undulating movement of members 8 and begin moving them to the left. FIG. 8 also illustrates the swiveling or pivotal movement of pulleys 46 relative to pivot mounts 50 and frame 6 in a counter-clockwise direction as viewed from above. Thus, this back and forth lateral or horizontal movement of the left and right hands generally in unison may continue back and forth to likewise move the undulation members 8 back and forth in an undulating fashion and generally in unison with one another, thereby causing the inner ends 10, weights 24, links 22, ends 36 and 38 and the upper and lower segments 42 and 44 of lines 30A-30D to move back and forth to the left and right, with or without the upward and downward movement of the inner ends 10, weights 24, links 22, ends 36 and 38 and the various segments 40, 42, and 44. Regardless of whether there is vertical movement of these various components during the lateral side-to-side movement, the inner ends 10 and associated components such as weight members 24, links 20 and ends 26 and 38 will tend to move forward and backward in response to the lateral side-to-side movement of the hands and undulation members.

Figure 9:
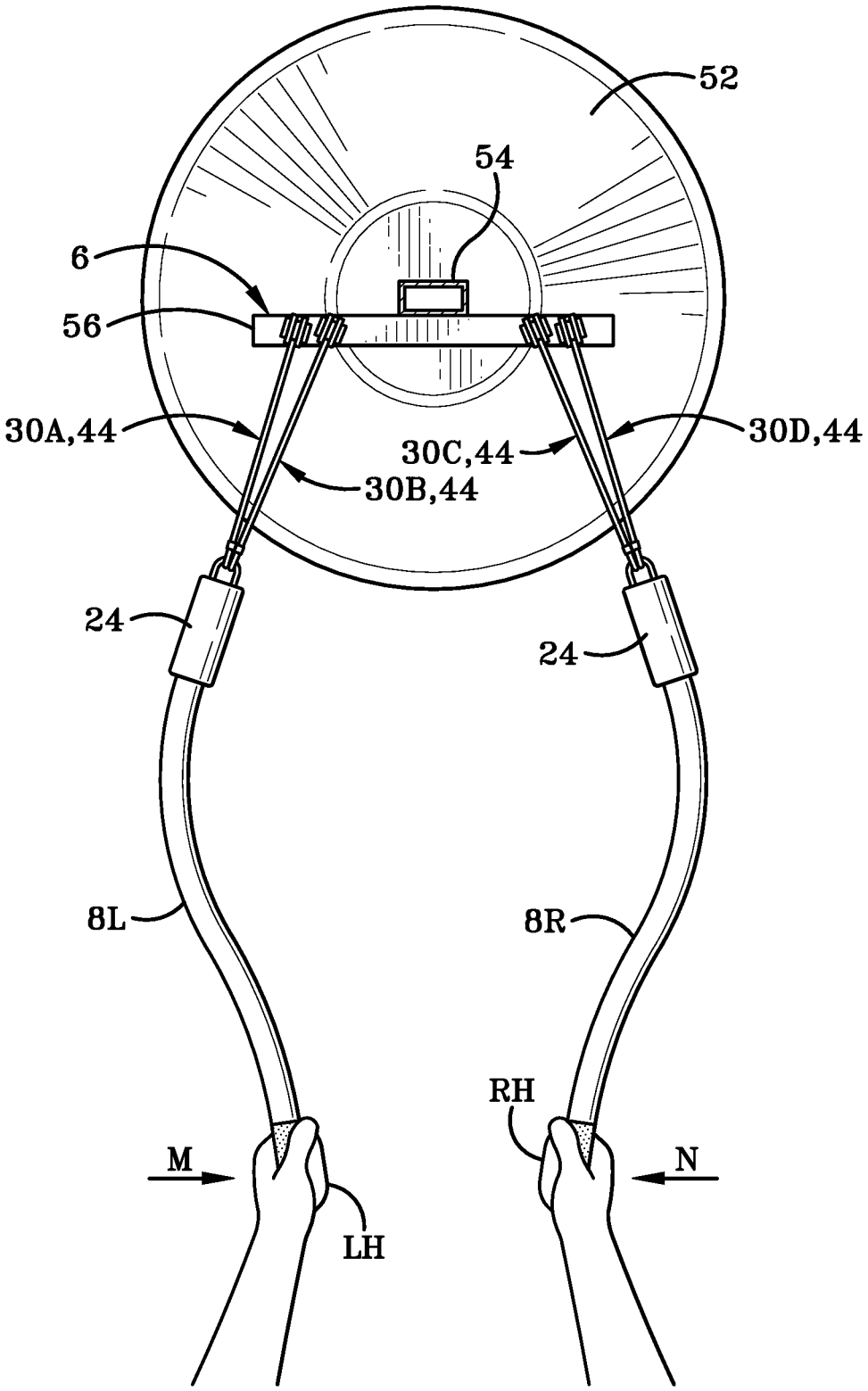
FIG. 9 is similar to FIG. 8 and shows an additional operational view.
Figure 10:
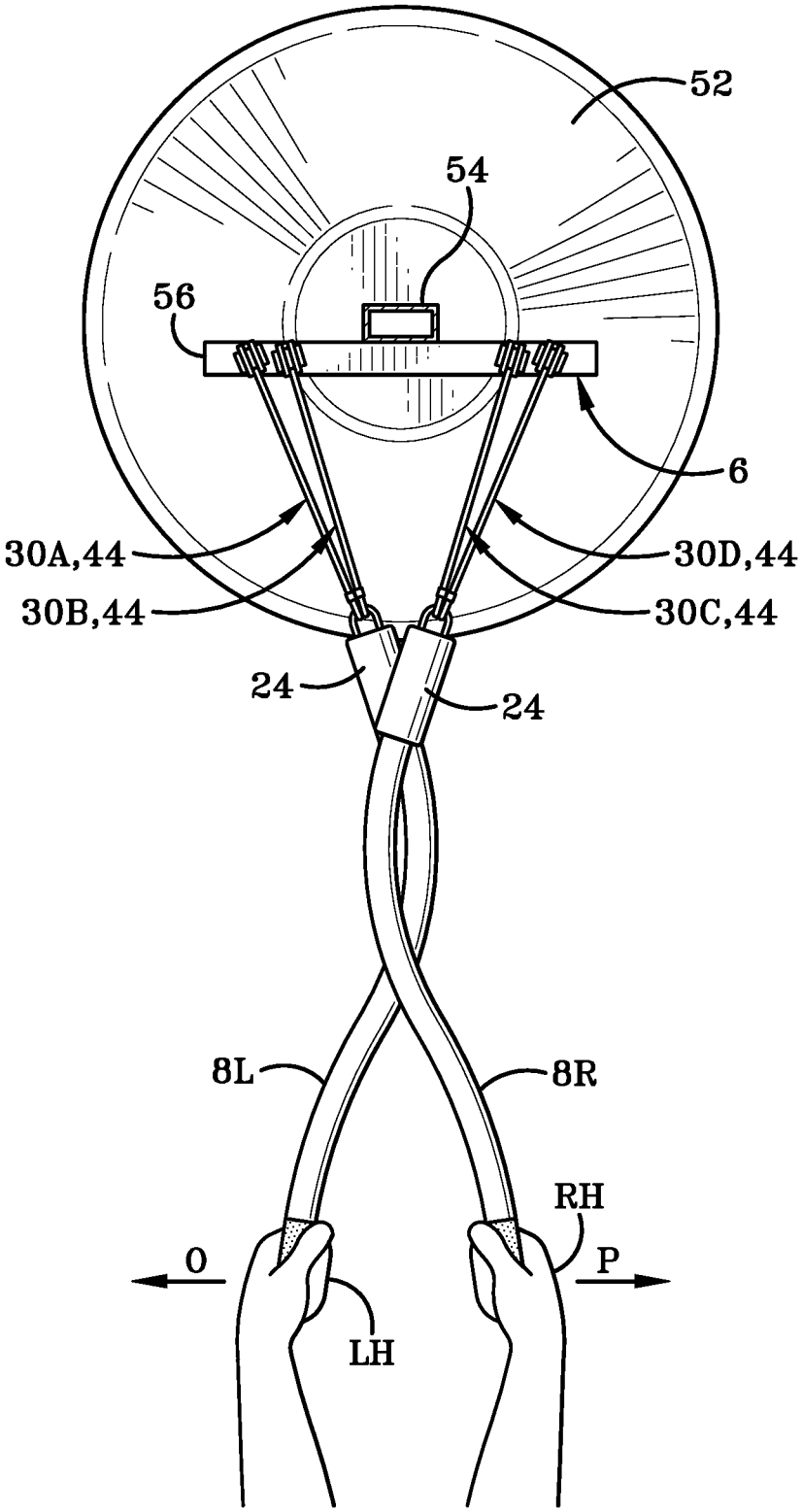
FIG. 10 is similar to FIG. 9 and shows an additional operational view.

FIGS. 9 and 10 illustrate the lateral and typically generally horizontal movement of the left and right hands and the undulation members 8 in opposing directions instead of generally in unison. More particularly, FIG. 9 shows the left hand LH moving toward the right as shown at Arrow M and the right hand RH moving toward the left as shown at Arrow N, with the undulation members 8L and 8R generally being spaced away from one another and beginning to move back toward one another in response to the movement of the hands toward one another. The upper and lower segments 42 and 44 of the left lines 30A and 30B are angled forward and to the left with the corresponding pulleys 46 rotated clockwise as viewed from above, while the upper and lower segments 42 and 44 of lines 30C and 30D are angled forward and to the right from the corresponding pulleys and the corresponding pulleys being rotated counter-clockwise as viewed from above. Part of the result of the inward movement of the left and right hands shown at Arrows M and N in FIG. 9 is illustrated in FIG. 10, wherein portions of members 8L and 8R overlap one another as viewed from above, having moved inwardly toward one another in general. FIG. 10 also illustrates the outward movement of the hands away from one another and more particularly the movement of the left hand LH to the left as indicated at Arrow O and the right hand to the right as indicated at Arrow P to begin the corresponding respective left and right movement of members 8L and 8R back toward the position shown at FIG. 9. At the stage shown in FIG. 10, the upper and lower segments 42 and 44 of lines 30A and 30B angle forward and to the right with the corresponding sheaves 32 and 34 rotated counter-clockwise as viewed from above, while the upper and lower segments 42 and 44 of lines 30C and 30D angle forward and to the left with the corresponding sheaves 32 and 34 rotated clockwise as viewed from above. Thus, the user may move the left and right hands back and forth toward and away from one another in a lateral or horizontal fashion to cause similar lateral or horizontal back and forth movement of members 8L and 8R toward and away from one another, and may continue this as long as desired. Thus, this lateral back and forth movement, whether in unison or in opposite directions simultaneously, provides different types of exercise than the vertical movement described with respect to FIGS. 3-6.

Throughout the side to side movement of the left and right undulation members 8, the inner ends 10 thereof move back and forth side to side in the generally horizontal direction, such that inner ends 10, link 22 and ends 36 and 38 may stay at substantially the same height during a given period or may occur at different heights. For instance, the user may position one hand higher than the other hand during the undulation of members 8 whereby one member 8 is higher than the other member 8 and the such that inner ends 10, link 22 and ends 36 and 38 associated with the higher member 8 are higher than the inner ends 10, link 22 and ends 36 and 38 associated with the lower member 8. Thus, as with the up and down movement of undulation members 8, each member 8 is anchored to a movable anchor which may be positioned at varying heights during undulation of members 8.

Returning to FIG. 4, the use of exercise device 1 may also include the movements as shown by the dashed lines. More particularly, instead of moving the hands in opposite directions simultaneously in an upward and downward or vertical motion, the hands may be moved generally in unison upwardly and generally in unison downwardly. More particularly, FIG. 4 illustrates the right hand and left hand in dashed lines adjacent the top of FIG. 4 in dashed lines moving upward generally in unison as indicated at Arrow Q and then generally in unison downwardly as indicated at Arrow R. Likewise, the dashed lines of right and left hands adjacent the bottom of FIG. 4 in dashed lines illustrates the downward movement of both hands generally in unison at Arrow S and generally in unison upwardly at Arrow T. Thus, instead of the left and right undulation members 8L and 8R moving generally in opposite directions upwardly and downwardly from one another, they generally move in unison upwardly and downwardly together in a motion which is often referred to in the use of rope exercises as a "slam." Although the hands and undulation members are moving upwardly and downwardly in unison, it is readily understood that the undulation members undergo undulating movement as a result of the upward and downward movement of the hands and at the inner ends 10 of the undulation members along with the associated components including weight members 24, links 22, ends 36 and 38 and the upper and lower segments 42 and 44 of lines 30A-30D move upwardly and downwardly as well as forward and rearward during these upward and downward movement of the hands and undulation members. Likewise, the upper and lower segments 42 and 44 lengthen and shorten as the components adjacent inner ends 10 move upwardly and downwardly and cause the respective rotation back and forth of the sheaves 32 and 34, while the rear segments 40 stay substantially the same length throughout the various exercises of the hands and undulation members in unison.

The user may perform additional exercises which may involve a combination of the up and down and lateral movement of the hands, undulation members and so forth. For example, one or more hands may be moved in along an arcuate path, such as in a generally circular pattern, causing the corresponding generally circular movement of undulation members 8 along with the generally circular movement of the associated components including weight members 24, links 22, ends 36 and 38, which would also include travel of a given line 30 around the upper and lower sheaves, thus causing rotation of the sheaves. Likewise, one or more hands may be moved in a generally semicircular back and forth pattern, such as when the user does a jumping jack type exercise while gripping the undulation members, causing the corresponding generally semicircular back and forth movement at least a portion of undulation members 8 (and typically the entire undulation member) along with the generally semicircular movement of the associated components including weight members 24, links 22, ends 36 and 38, which would also include back and forth travel of a given line 30 around the upper and lower sheaves, thus causing rotation of the sheaves. The arcuate path or movement, such as the circular and semicircular movement of the hands and the resulting analogous movement of the components as noted above, is shown by the dashed line arcuate arrows in FIG. 1. The arcuate movement of one or more hands, undulation members 8 and associated components thus involves up and down movement and side to side movement which may be perpendicular to the up and down movement. It is noted that during the undulation of members 8 in the up and down direction or the side to side direction or the semicircular or circular directions, undulation members 8 may move so that no portion of either member 8 touches floor F or the ground. This may likewise be true of all the embodiments herein.

During the various exercises described above, the step of moving the first hand back and forth causes each of segments 42 and 44 to change length. This change in length may occur because of the stretching of line 30 and/or because the ends 36 and 38 and adjacent points (e.g., along line 30, link 22, end 10) move closer or further away from the given upper or lower sheave. During the up and down undulating movement, ends 36 and 38 move upward in response to the upward movement of inner end 10 of member 8 so that upper segment 42 becomes shorter and lower segment 44 becomes longer as ends 36 and 38 move toward upper sheave 32 and away from lower sheave 34, and then ends 36 and 38 move downward in response to the downward movement of inner end 10 of member 8 so that upper segment 42 becomes longer as ends 36 and 38 move away from upper sheave 32 and toward lower sheave 34.

Figure 11:
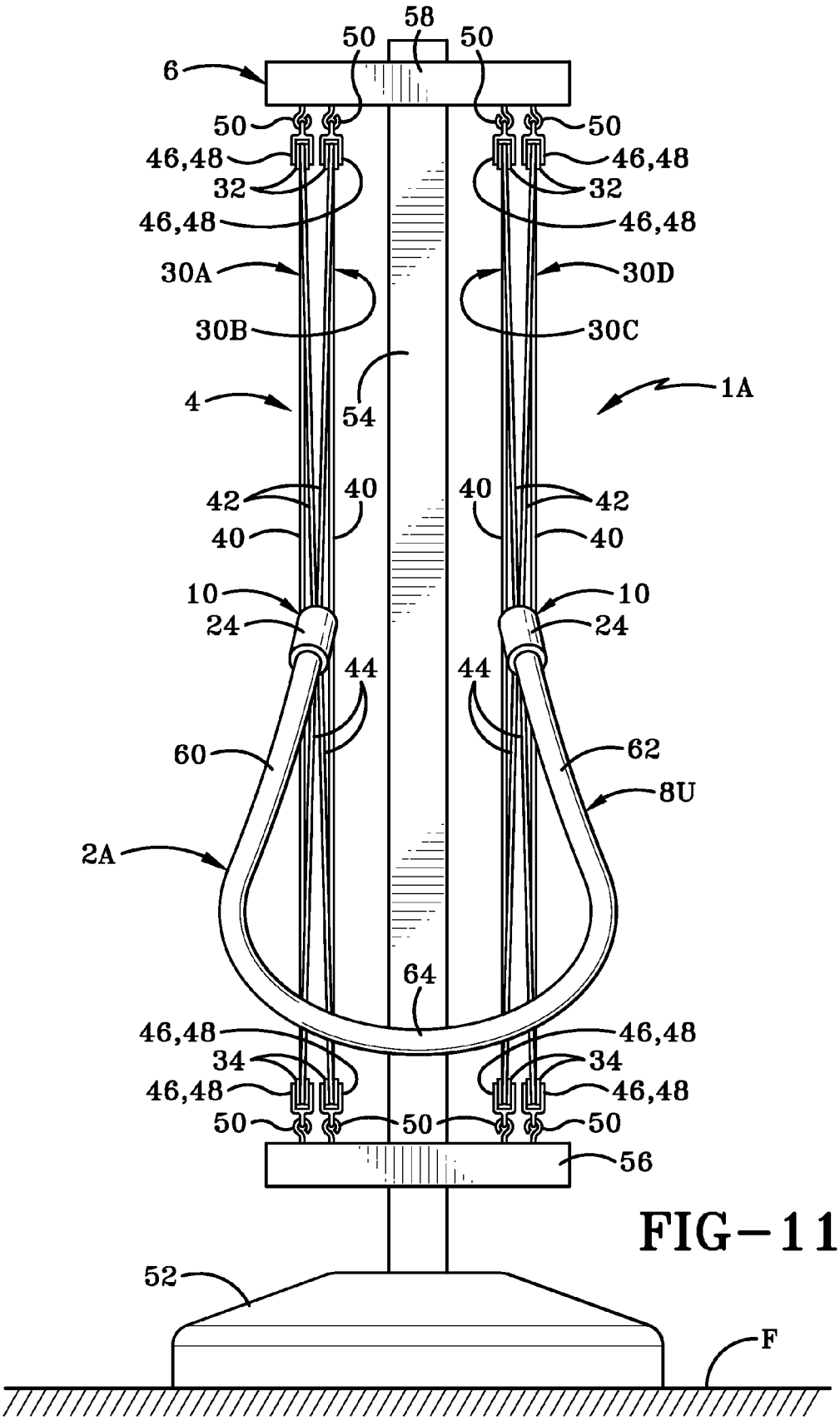
FIG. 11 is a front elevation view of another embodiment of the exercise device with a U-shaped undulation assembly.
Figure 12:
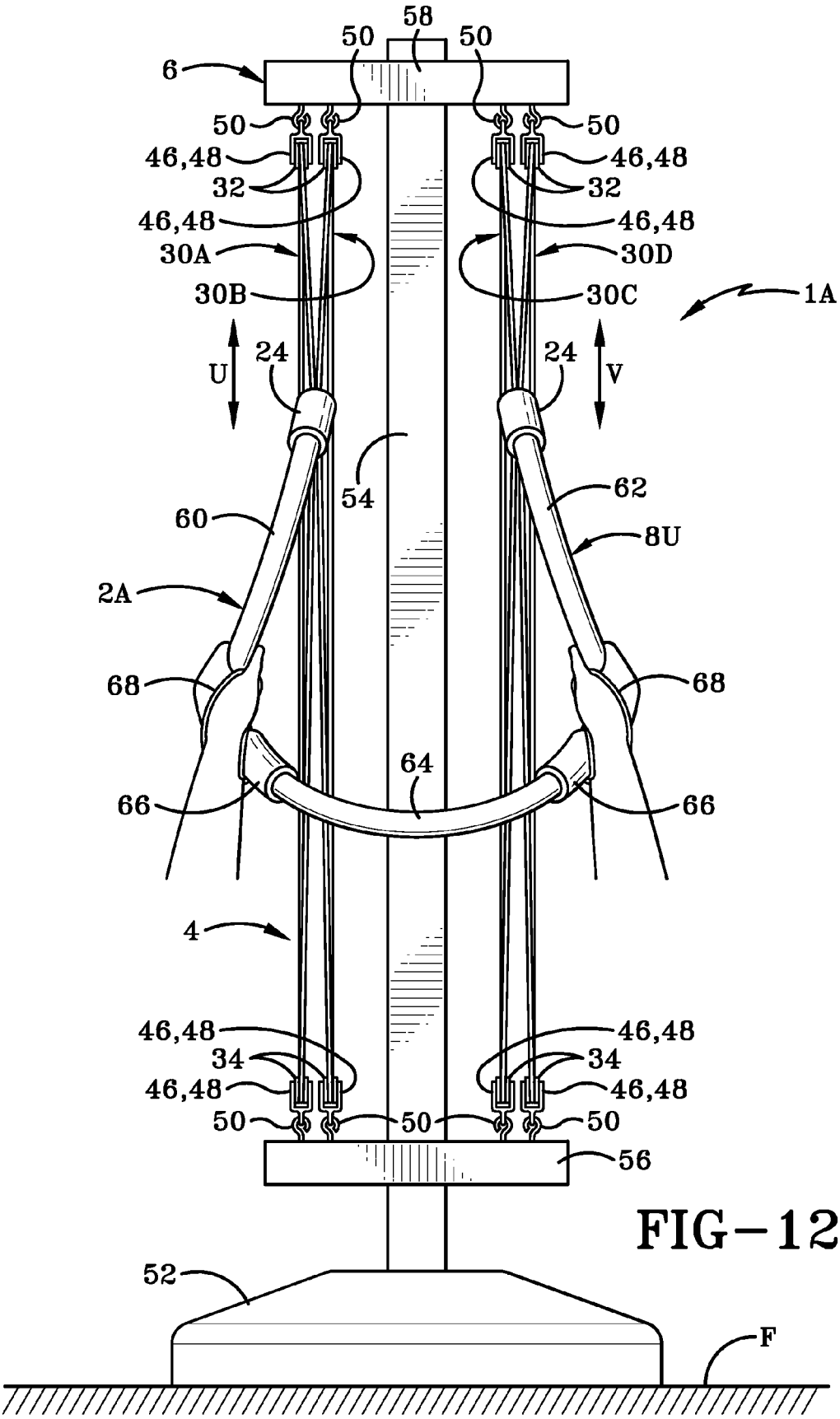
FIG. 12 is a front elevation view of the device of FIG. 11 shown in use with additional weights.

A modified embodiment of the exercise device is shown in FIGS. 11 and 12 and generally denoted at 1A. Exercise device 1A is similar to device 1 except that it includes a different or modified undulation assembly 2A. Undulation assembly 2A is operatively connected to each of the shock absorbing assemblies, whereby movement of assembly 2A causes movement of each of the shock absorbing assemblies and vice versa. In contrast to assembly 2, undulation assembly 2A has a U-shaped configuration and may use a single undulation member 8U which has a U-shaped configuration. Undulation member 8U may be formed as a single elongated member or line which may be made of the materials as discussed with the left and right undulation members 8L and 8R above. The U-shaped undulation member 8U includes a left segment 60, a right segment 62, and an intermediate or outer segment 64 which extends between and is connected to the outer ends of left and right segments 60 and 62. Inasmuch as member 8U may be formed as a single elongated member, it has two inner terminal ends 10 (which serve as ends of assembly 2A) with links 24 extending inwardly therefrom (although not shown) in the same manner as described previously such that ends 36 and 38 of the respective lines 30A-30D are connected to the corresponding links in the same manner as discussed previously. The left inner end 10 is thus the inner end of left segment 60 while the right inner end 10 is the inner end of segment 62. Member 8U has a length from left inner end 10 to right inner end 10 typically in a range of about 4 to 8 feet although this may vary. Generally, the center or central portion of segment 64 serves as the outer end or outer portion of member 8U, which is during operation furthermost from inner ends 10, weights 24, links 22, lines 30 and the frame 6 generally including upright 54 and crossbars 56 and 58, as well as from pulleys 46. As shown in FIG. 12, assembly 2A may be configured with additional weights or weight members 66 which are analogous to weights 24 and typically have a weight within the same or a similar range as discussed above with respect to weight members 24. Weight member 66 may be formed in a similar manner as discussed with respect to weight members 24 above although in the sample embodiment, weight members 66 are typically formed in a manner that allows them to slide along the length of undulation member 8U such that each weight member 66 may be moved to any desired location along the length of member 8U. Weight member 66 may be removably or non-removably mounted on the member 8U. Weight member 66 may conveniently be made as a sand weight or other type of weight which wraps all the way around a portion of member 8U. A flexible strap 68 may be provided which is secured to weight member 66 and extends outwardly therefrom, typically such that strap 68 forms a loop which the user may stick a hand through as shown in FIG. 12. Thus, although weight member 66 may be configured to slide up and down the length of the rope or undulation member 8U, the user may insert his or her hands through the loops formed by straps 68 and grab a portion of the strap and undulation member 8U simultaneously at a desired gripping location distal inner ends 10 whereby straps 68 limit the movement of weight member 66 along the length of undulation member 8U inasmuch as the user is gripping both strap 68 and undulation member 8U at a given gripping location during the use of device 1A.

Inasmuch as undulation member 8U may be a single elongated flexible member, it is best configured (especially where the length is generally shorter) for the up and down movement of the left and right hands in unison as opposed to moving in opposite directions from one another. This generally upward and downward unison type movement is illustrated by the movement of the left hand and left segment 60 at Arrow U and the right hand and right segment at Arrow V in FIG. 12. Although not shown, U-shaped undulation member 8U may also be moved in an undulating manner laterally and typically generally horizontally as generally described above with respect to members 8L and 8R whether or not there is any vertical movement and rotation of the sheaves 32 and 34. Although weight members 66 and straps 68 are shown in use with the U-shaped undulation member 8U, it is noted that they may be used with a straight or generally straight piece of rope or other undulation member such as those shown at 8L and 8R. It is further noted that the weight member 66 may be positioned inwardly of the hands and straps 68 such that weight members 66 are between or intermediate ends 10 or weight members 24 and through corresponding hand and strap 68 instead of further outwardly as depicted in FIG. 12.

Although it is noted above that U-shaped member 8U may be best configured for moving the hands up and down generally in unison, this is not necessarily the case especially where its length is generally longer inasmuch as sufficient length allows for the user to move hands upwardly and downwardly simultaneously in opposite directions. Thus, member 8U may, for instance, be suitable for use with both hands moving up and down together or simultaneously in opposite directions, or for use with one hand moving up and down together. The use of one hand thus increases the difficulty or resistance to the muscles associated with using only one hand due to the requirement of moving with only one hand undulation member 8U, weight members 24, along with the resistance of additional lines 30 and any resistance mechanism used, such as mechanism 51 shown in FIG. 2.

Figure 12A:
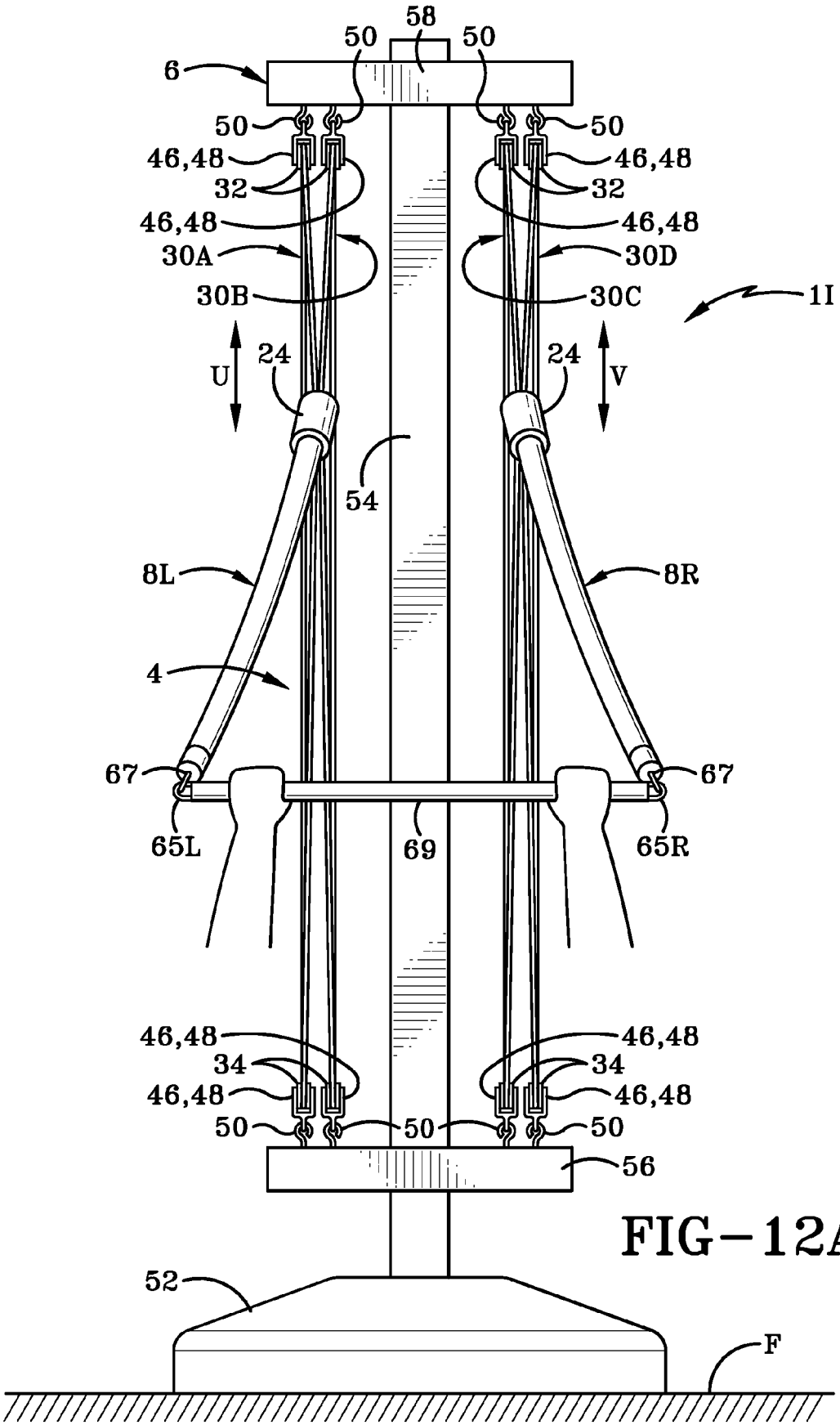
FIG. 12A is a front elevation view of another embodiment of the exercise device with a gripping handle connected to two undulation members.

FIG. 12A shows another embodiment which provides a different type of U-shaped undulation assembly which includes left and right undulation members and a bar or rod assembly or handle assembly having a bar or rod or handle 69 which extends between and is connected to the outer ends of the undulation members. In the sample embodiment, the rod assembly includes left and right end links 65L and 65R are respectively secured to the left and right ends of rod 69. In addition, a link 67 is secured to the outer end of each undulation member 8. Left end link 65L is looped through or linked to the link 67 of the left undulation member 8 to pivotally secure the left end of rod 69 to the outer end of the left undulation member 8. Likewise, right end link 65R is looped through or linked to the link 67 of the right undulation member 8 to pivotally secure the right end of rod 69 to the outer end of the right undulation member 8. Rod 69 may be rigid or flexible. Thus, rod 69 may be formed of rigid material such as a metal or rigid plastic. Rod 69 may also be formed as a flexible member and may serve as a weight member analogous to weight member 24 typically with a weight in the same range as previously discussed. A flexible rod may, for example, be in the form of an elongated sand weight. Handle or rod 69 includes gripping locations where the user may grip rod 69. The gripping locations when the user grips rod 69 may be adjacent the opposed ends of rod 69 (as shown by the location of the hands in FIG. 12A) or anywhere along rod 69. The user may also grip handle or rod 69 with only one hand, which would typically be at a central gripping location midway between the opposed ends of rod 69 although this may vary. Like U-shaped member 8U, the undulation assembly with rod 69 is typically used (when the user elects to use both hands) with the hands moving up and down generally in unison, side to side generally in unison, or along an arcuate path (e.g., circular or semicircular) generally in unison. However, moving the hands in opposite directions simultaneously is also possible.

Figure 13:
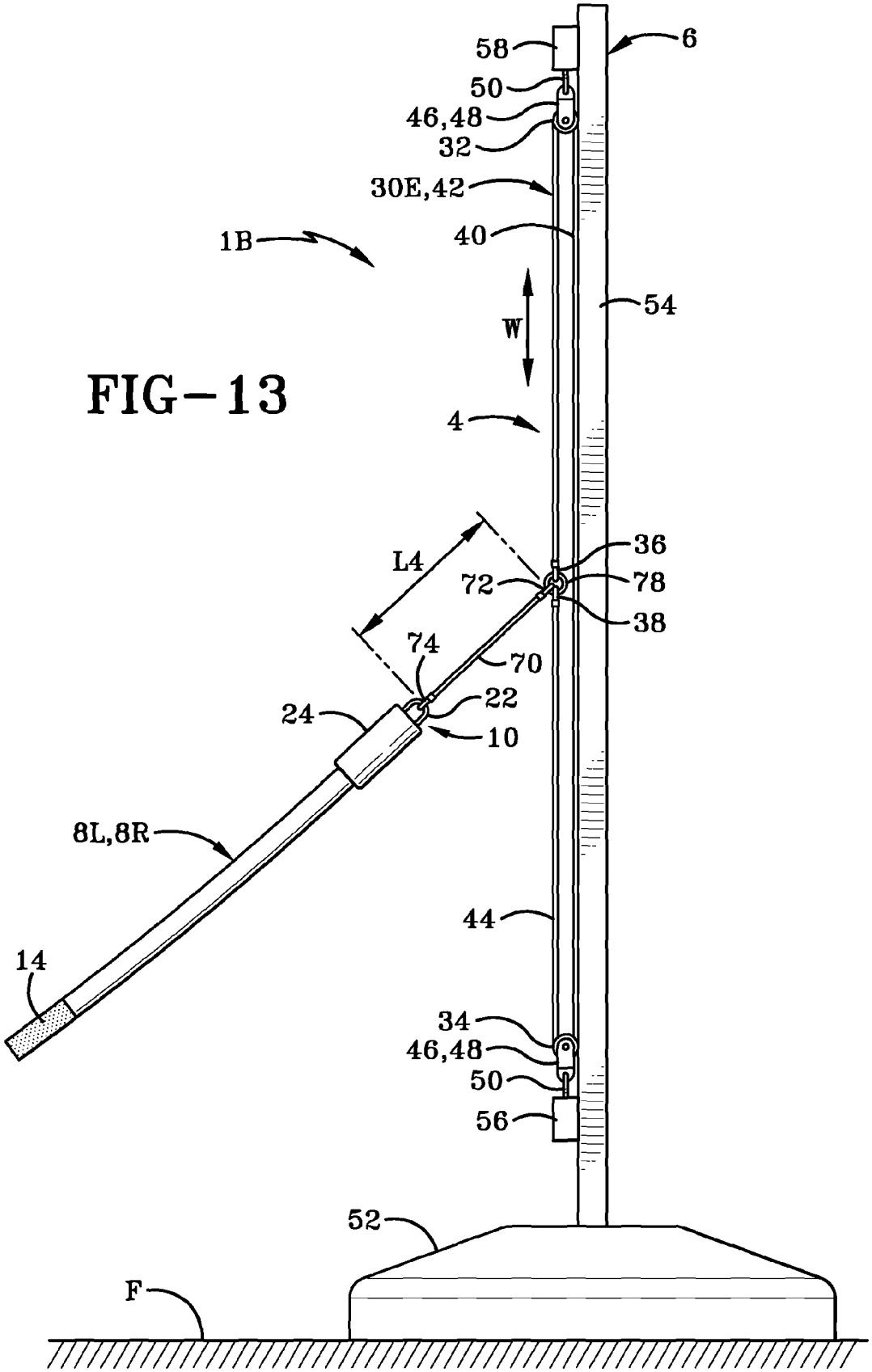
FIG. 13 is a right side elevation view of another embodiment of the exercise device with a connector line between the undulation member and travel line.

FIG. 13 illustrates a modified exercise device 1B which is similar to device 1 in that it includes frame 6 and one or more undulation members 8L and 8R. For purposes of simplicity, the undulation member will simply be referred to as undulation member 8 with the understanding that multiple undulation members and/or associated lines may be used. Device 1B includes a pulley line or travel line 30E which is analogous to lines 30A-30D and may be an elastic line or a non-elastic line which is nonetheless flexible but essentially not stretchable. For instance, line 30E may be formed with a cable typically made of metal and may also include a softer coating such as vinyl, nylon or some other plastic material which encases the metal cable substantially along its entire length. Typically, such a metal cable and coating would extend from adjacent one end of the travel line to adjacent the other end thereof. The shock absorbing assembly of device 1B includes an elastic connector line 70 which is connected to the inner end of undulation member 8 and to line 30E. More particularly, elastic line 70 has inner and outer opposed ends 72 and 74 which are typically formed as end loops such that at the loop of outer end 74 loops around link 22 to secure the line 70 to member 8. The inner end loop 72 may be secured to a typically closed loop 78 which may be formed of metal or another rigid material. In the sample embodiment, the ends or loops 36 and 38 of line 30E are likewise looped and secured to link 78. Ends 72 and 74 define therebetween a length L4 of line 70 which typically falls within a range of about 4 to 24 inches although this may vary somewhat.

The user may operate device 1B in a relatively similar manner as discussed above with respect to device 1. However, where line 30E is a non-stretchable line, the sole or primary shock absorbing member is the elastic line 70. Thus, when the user grips handle 14 in his or her hand or hands upwardly and downwardly as indicated at Arrow W in FIG. 13, the undulation member 8 likewise moves upwardly and downwardly accordingly and likewise causes the upward and downward movement of elastic line 70 along with link 78, ends 36 and 38 and the upper and lower segments 42 and 44, while rear segment 40 typically moves in the opposite direction of the hands in these other members. Sheaves 32 and 34 rotate in a similar manner as discussed previously. The main distinction is that elastic line 70 may be used with a non-stretchable line 30E and still provide the shock absorbing characteristics previously discussed such that the user does not experience the jerking or jarring force which typically occurs as the weight member 24 changes direction at the bottom from downward to upward or at the top of its movement from upward to downward. During the up and down movement of the hand or hands and the corresponding undulation member 8 and weight member 24, elastic line 70 will stretch and contract and thus inner end 10, weight member 24, link 22 and outer end 74 will variously move closer and further away from upright 54, rear segment 40 and upper and lower segments 42 and 44 and link 78. As noted above, line 30E may also be an elastic line as discussed with respect to lines 30A-30D above whereby the shock absorbing assembly will include both the elastic line 30E and elastic line 70.

Figure 13A:
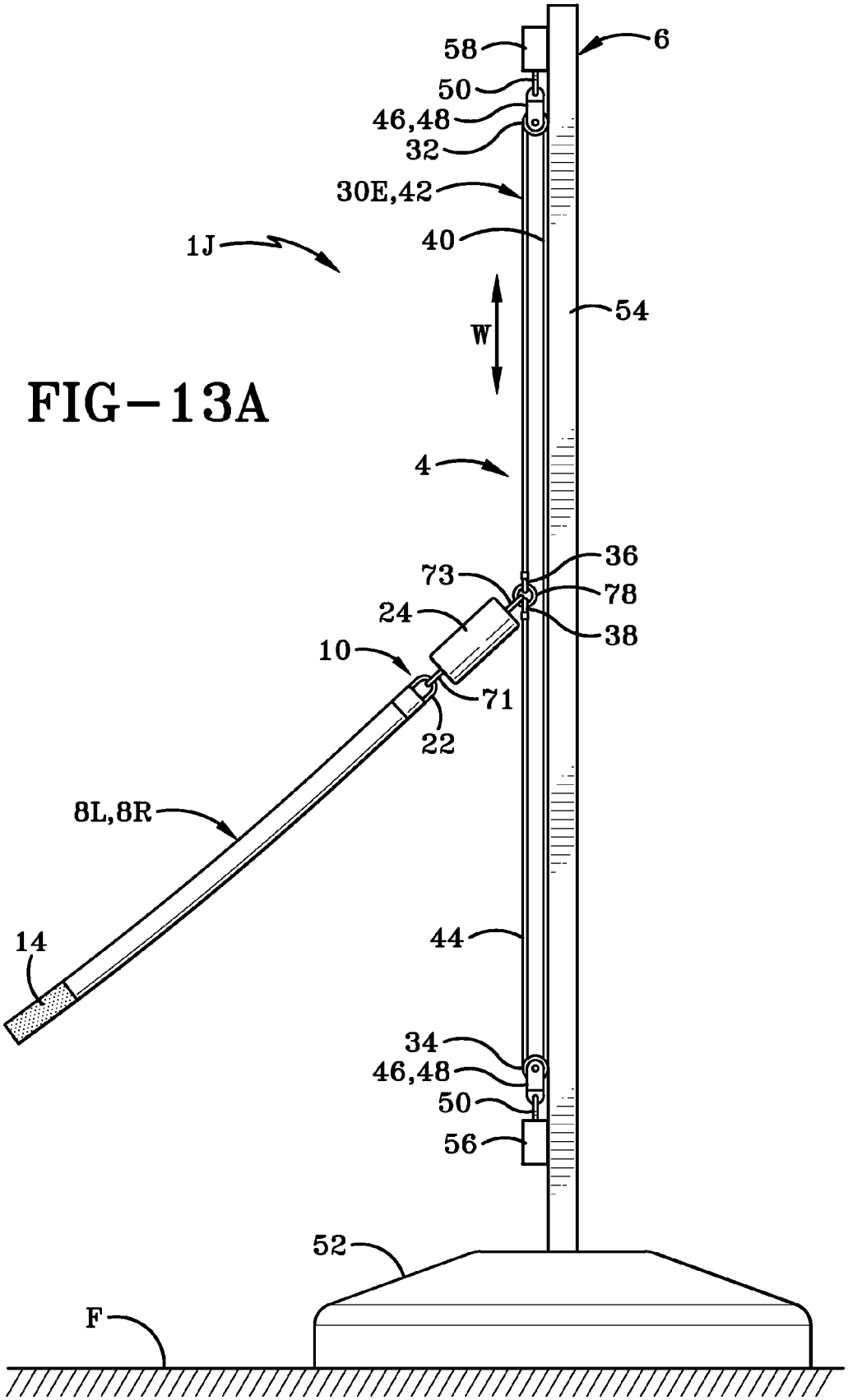
FIG. 13A is a right side elevation view of another embodiment of the exercise device with a weight member between the undulation member and travel line.

FIG. 13A shows another embodiment of the exercise device with a weight member 24 between undulation member 8 and travel line 30. Weight member 24 extends between and is connected to first end 10 of member 8 via link 22 and terminal ends or end loops 36 and 38 of travel line 30 such that weight member 24 is adjacent first end 10, link 22, and ends 36 and 38. Weight member 24 includes a weight body with first and second links on opposite ends thereof, which may be referred to as an outer link 71 secured to an outer end of the weight body and an inner link 73 secured to an inner end of the weight body. Outer link 71 is looped through or linked to inner link 22 of undulation member 8 to pivotally secure weight member 24 to link 22 and the inner end of member 8. Inner link 73 is looped through or linked to link 78, which is linked to end loops 36 and 38, to pivotally secure weight member 24 to link 78 and end loops 36 and 38. Link 73 may also be looped through or linked to terminal end loops 36 and 38 to pivotally secure weight member 24 to end loops 36 and 38 without the use of link 78, or with the use of one or more additional links, as with the other embodiments where the various links are used. The embodiment of FIG. 13A may be used in the same manner as described above, and shows another manner of connecting the weight member.

Figure 13B:
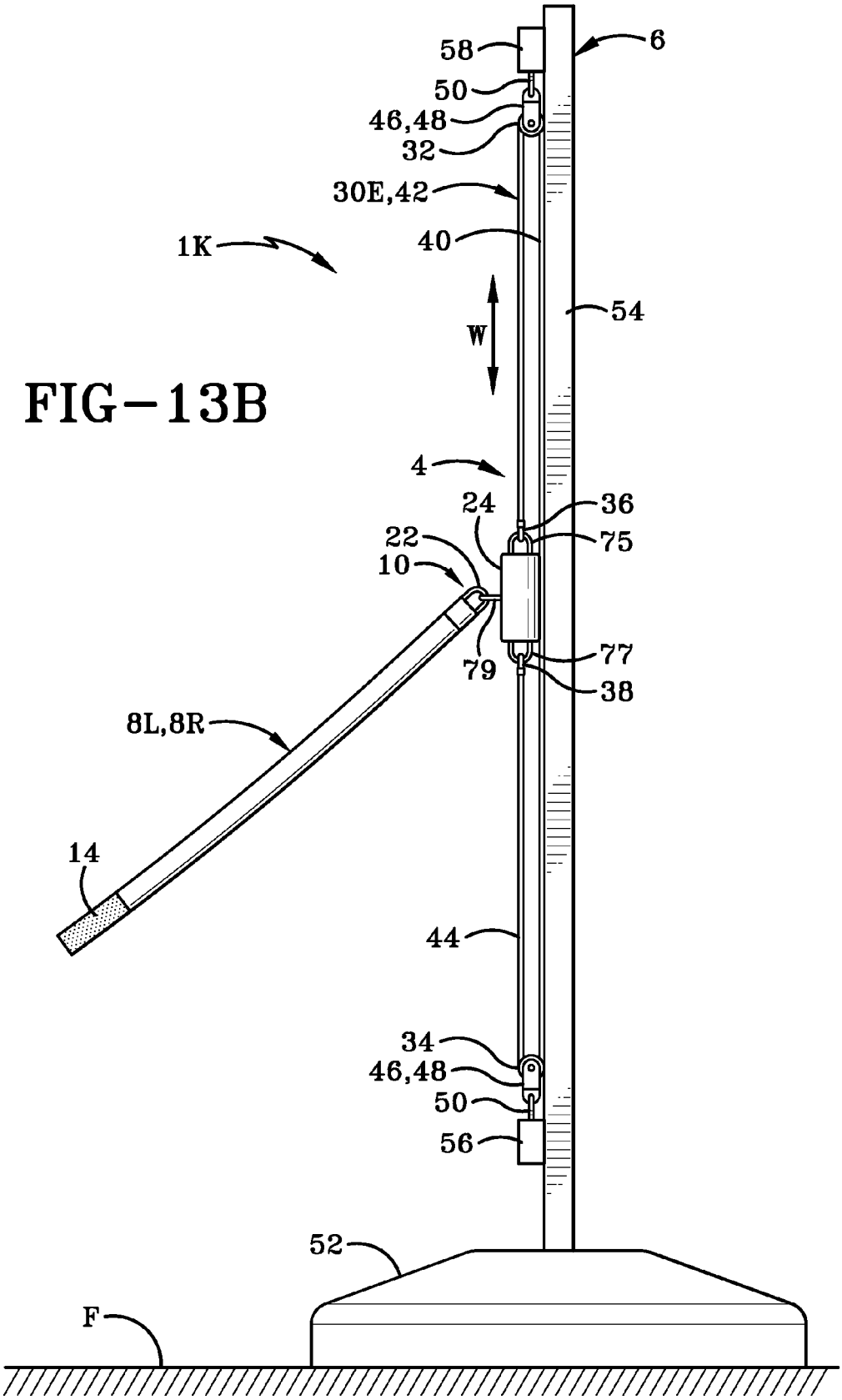
FIG. 13B is a right side elevation view of another embodiment of the exercise device with a weight member between two ends of the travel line.

FIG. 13B shows another similar embodiment of the exercise device with a weight member 24 between terminal ends 36 and 38 of travel line 30. Weight member 24 extends between and is connected to terminal ends or end loops 36 and 38 and also extends between and is connected to first end 10 of member 8 via link 22 and terminal ends 36 and 38 such that weight member 24 is adjacent first end 10, link 22, and ends 36 and 38. Weight member 24 includes a weight body with first and second links on opposite ends or sides thereof, which may be referred to as an upper link 75 secured to an upper end or side of the weight body and a lower link 77 secured to a lower end or side of the weight body. Member 24 includes a third link which may be referred to as an inner link 79 secured to an inner end or side of the weight body. Link 75 is looped through or linked to terminal end loop 36 to pivotally secure weight member 24 to end loop 36. Link 77 is looped through or linked to terminal end loop 38 to pivotally secure weight member 24 to end loop 38. Link 79 is looped through or linked to inner link 22 of undulation member 8 to pivotally secure weight member 24 to link 22 and the inner end of member 8. The embodiment of FIG. 13B may be used in the same manner as described above, and shows another manner of connecting the weight member.

Figure 14:
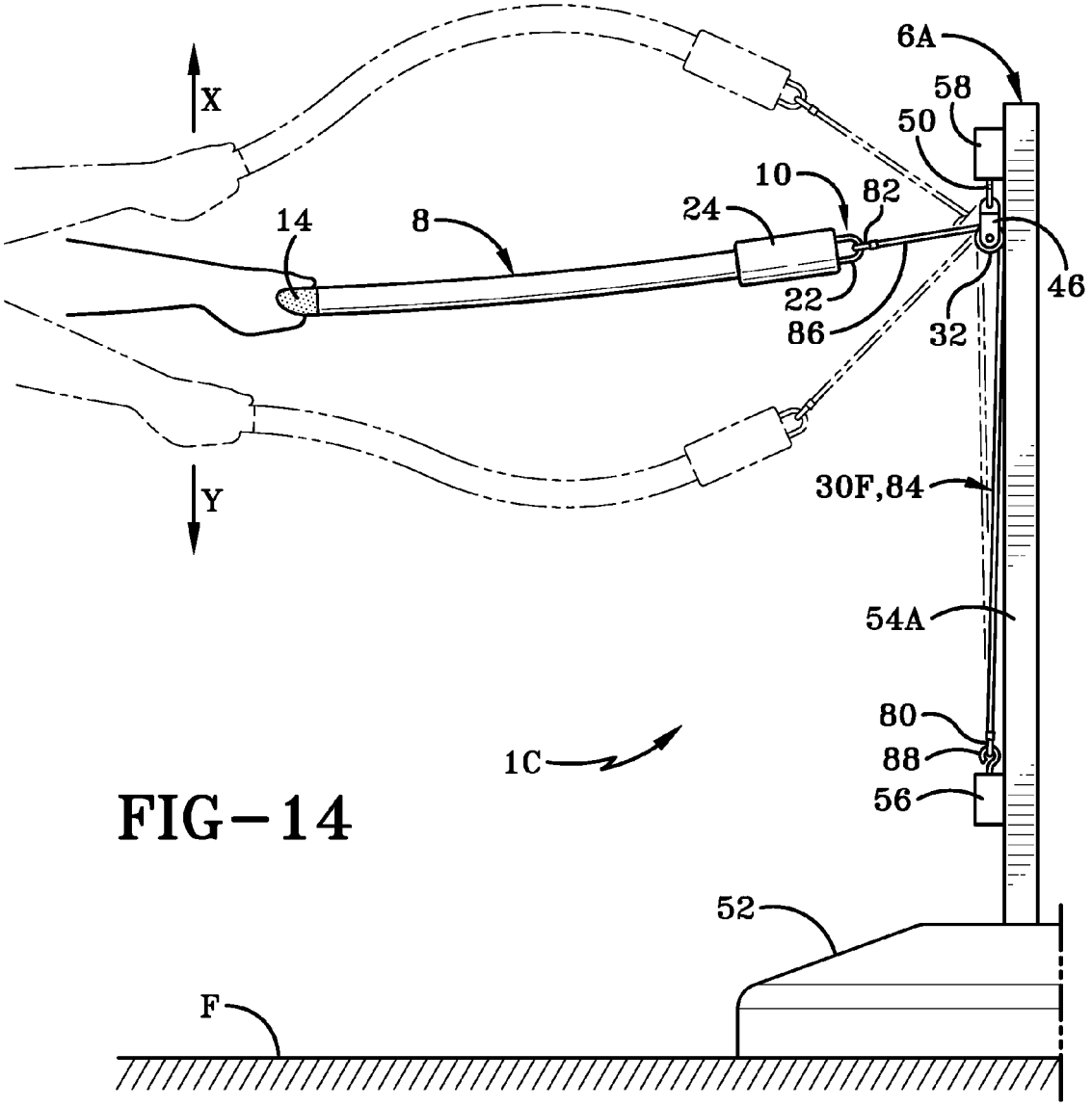
FIG. 14 is a right side elevation view of another embodiment of the exercise device.

An alternate exercise device 1C is shown in FIG. 14 and provides similar types of exercise while eliminating one pulley engaged by a given line compared to the previously described exercise devices. Device 1C thus retains a rigid frame 6A which is similar to but shorter than frame 6 and thus still includes a base 52, an upright 54A which is shorter than upright 54, and lower and upper crossbars 56 and 58 which are mounted in a similar manner as previously discussed. Device 1C likewise includes one or more undulation members 8 including handle 14 with a weight member 24 and link 22. Device 1C further retains the use of a pulley 46 with an upper sheave 32 which may be at a lower height but otherwise mounted in the same manner on pulley mount as previously discussed on the crossbar 58 which is lower than that of frame 6. Device 1C includes an elastic line 30F forming the key aspect of the shock absorbing assembly of device 1C. Line 30F has first and second ends 80 and 82 each typically formed as a loop whereby second end 82 is linked to link 22 and first end 80 is connected to a line mount 88 which is secured to lower crossbar 56. Line 30F thus includes a rear segment 84 which extends from mount 88 and end 80 to the back of sheave 32, and a front segment 86 which extends from link 22 and end 82 to the top of sheave 32.

As shown in FIG. 14, the user may move his or her hand or hands upwardly as shown at Arrow X and downwardly as shown in Arrow Y to thus cause the undulating movement of member 8 along with the upward and downward movement of inner end 10, weight member 24, link 20, end 82 and front segment 86 of line 30F, thus also causing the stretching of line 30F. This upward and downward movement of line 30F also causes back and forth rotation of sheave 32 due to the frictional engagement of line 30F therewith during its upward and downward and inward and outward movement. The user may also move the hands laterally side to side in a horizontal fashion if desired as previously discussed.

Figure 15:
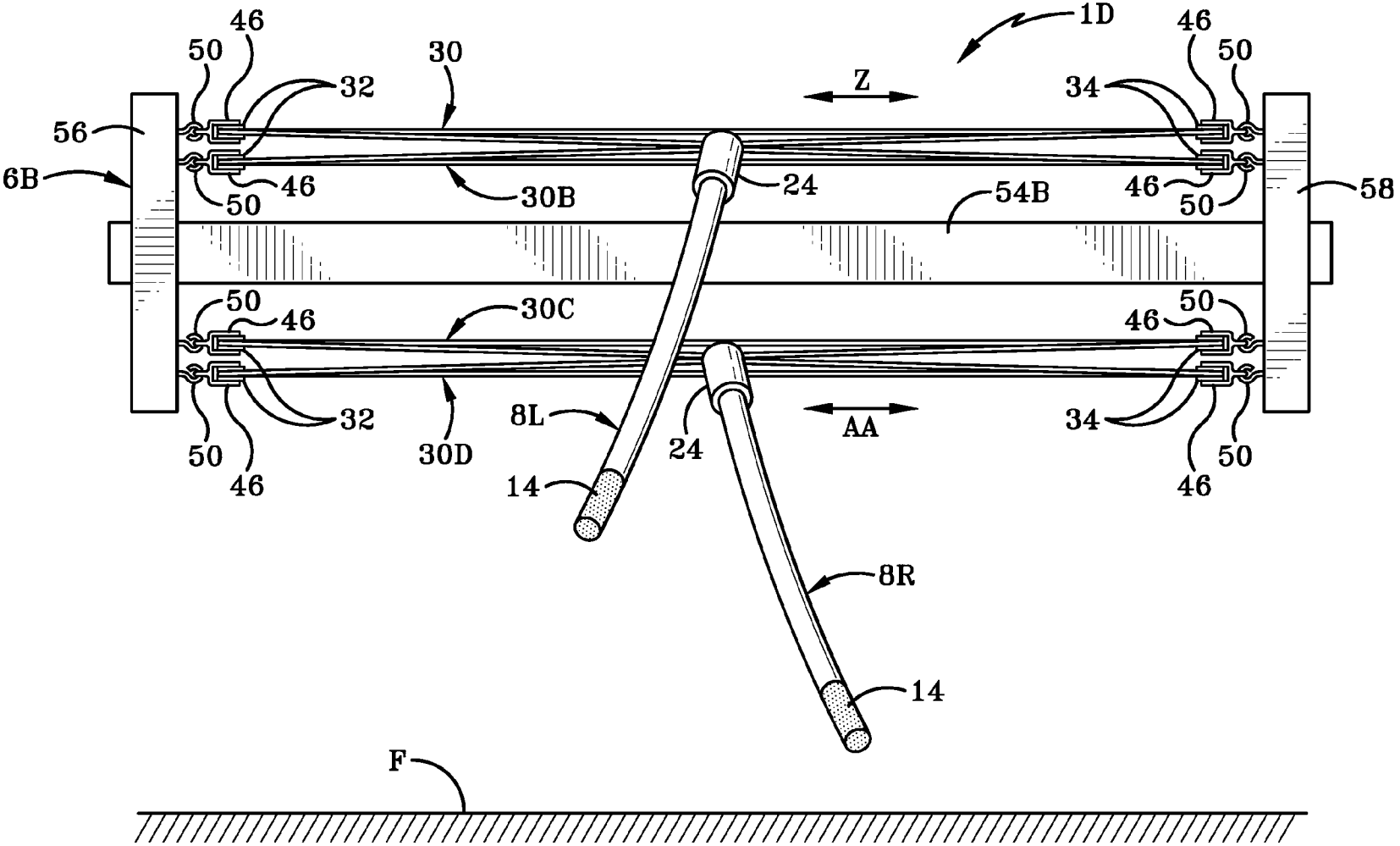
FIG. 15 is a front elevation view of another embodiment of the exercise device.

FIG. 15 shows an exercise device 1D which is similar to exercise device 1 with the primary exception being that it is mounted so that lines 30A-30D are substantially horizontal as opposed to being vertical. Device 1D thus retains a frame 6B which is similar to frame 6 except that it includes an elongated horizontal frame member 54B which is analogous to upright 54 except that it is turned horizontally, and likewise includes crossbars 56 and 58 which may be considered as left and right vertical crossbars instead of lower and upper crossbars. Device 1D thus retains mounts 50, pulleys 46, sheaves 32 and 34, elastic lines 30A-30D and undulation members 8L and 8R. Of course, the pulleys 46 and sheaves 32 and 34 may be considered as left and right pulleys and sheaves as opposed to upper and lower sheaves given the configuration is essentially a different orientation. Likewise, the undulation member 8L and 8R could be considered upper and lower undulation members, and the lines 30A and 30B may be considered upper lines while the lines 30C and 30D may be considered lower lines. Thus, lines 30A-30D are generally oriented in a horizontal fashion instead of vertical fashion. The overall use of device 1D is substantially similar to that of device 1 except that the user will move his or her hands to the left and right as indicated at Arrow Z and Arrow AA to cause the revolution of the various lines 30A-30D about the rotating sheaves 32 and 34, or may move his or her hands upwardly and downwardly in a manner which is analogous to the lateral movement described with respect to exercise device 1 except that the direction of movement is vertical instead of generally horizontal. It is also noted that device 1D may be mounted in a rotating manner to rotate between the horizontal orientation shown at FIG. 15 and a vertical orientation such as illustrated by the orientation of exercise device 1 in FIGS. 1 and 2. This would typically be done by some sort of a trunnion or other pivoting structure on which the frame 6B could be rotatably mounted relative to a wall or other frame. Although FIG. 15 shows one undulation assembly and shock absorbing assembly above another, they may alternately be located at the same height in a side by side orientation.

Figure 16:
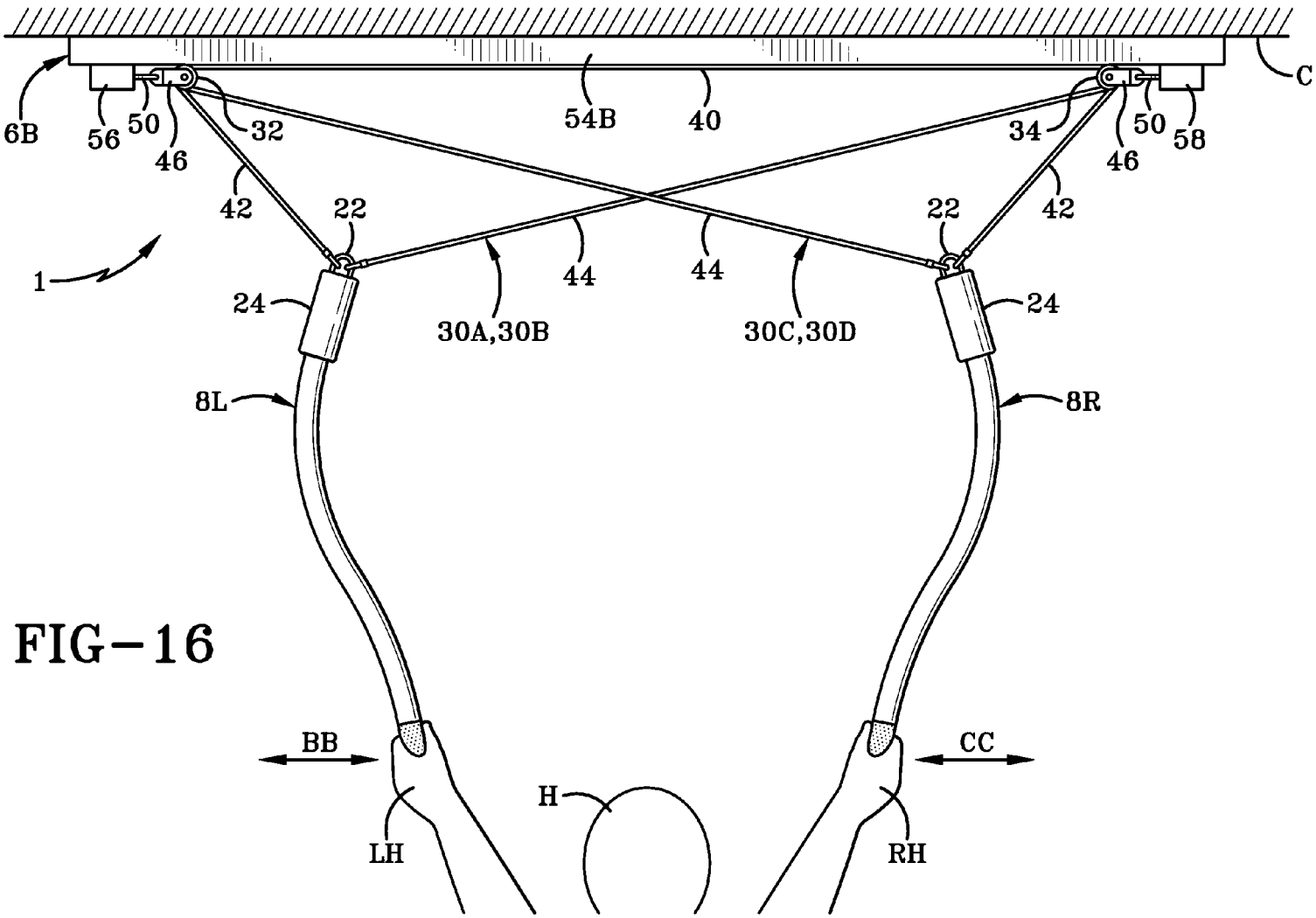
FIG. 16 is a front elevation view of another embodiment of the exercise device.

FIG. 16 shows another embodiment of an exercise device at 1E, which is similar to devices 1 and 1D except that it is mounted overhead instead of being mounted vertically or horizontally in the fashion noted with respect to devices 1 and 1D. Actually, device 1E is mounted in a horizontal fashion except that it is mounted on an overhead structure or ceiling such as ceiling C or another overhead structure like an I-beam, rafters or the like. Thus, device 1E retains frame 6B except that it has been mounted in a different orientation such that crossbars 56 and 58 are substantially horizontal, as is frame member 54B. FIG. 16 illustrates that the user grips the left member 8L with the left hand and the right member 8R with the right hand such that device 1E is generally above his or her head H, and then may move the left and right hands back and forth or generally as shown at Arrows BB and CC in a similar fashion as previously described except for the exercise is performed overhead and thus uses different muscles. The user may also move his hands forward and backward generally perpendicular to lines 30 and frame member 54B.

Figure 17:
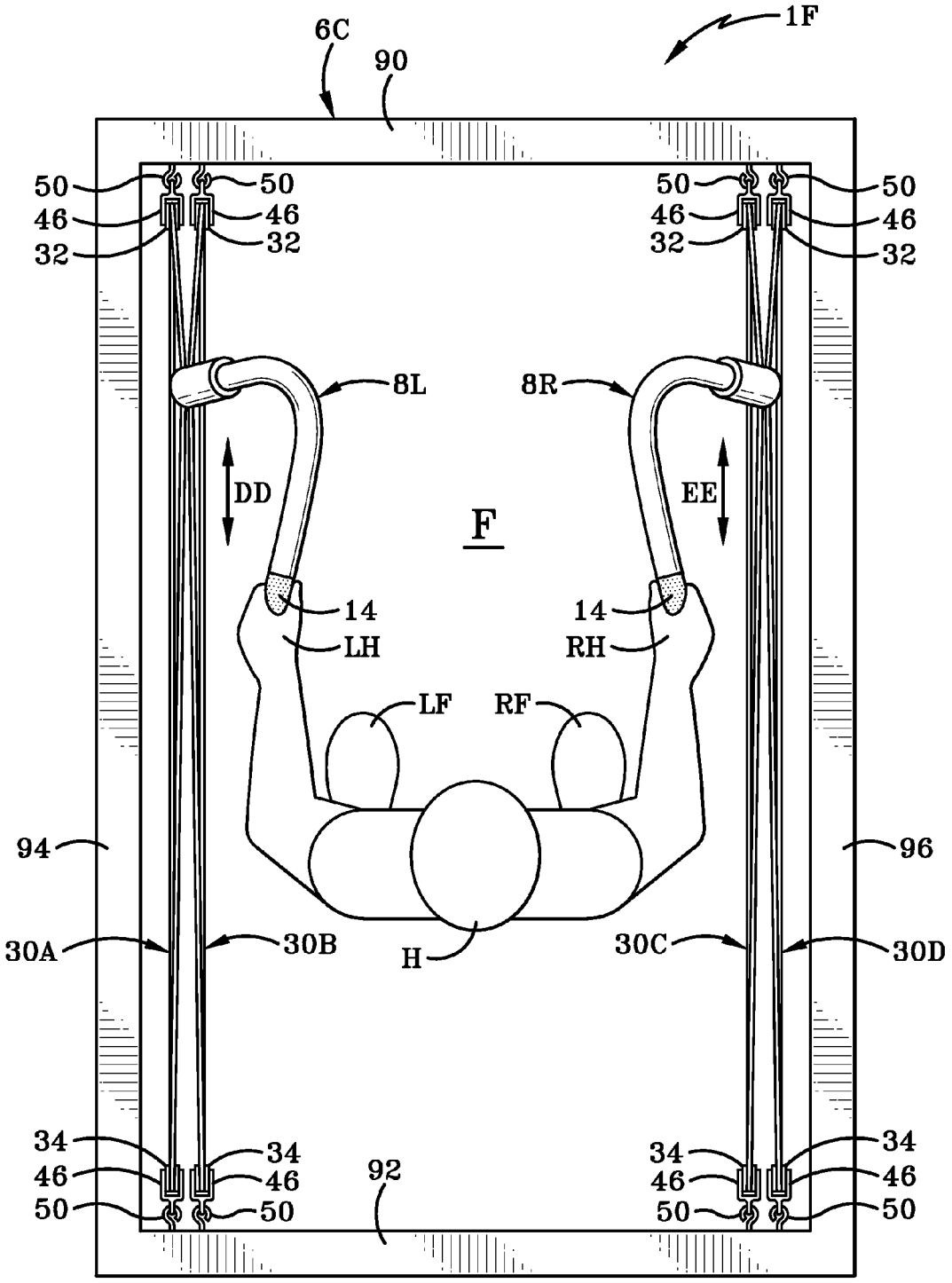
FIG. 17 is a top plan view of another embodiment of the exercise device.

FIG. 17 shows an exercise device 1F which is similar to devices 1, 1D and 1E except that it has been modified in order for the user to move the undulation members back and forth while the hands are extending downwardly and the elastic lines are generally horizontally oriented along the floor F or another platform on which the user may stand during operation. In the sample embodiment, device 1F includes a frame 6C which is also a rigid structure including a front crossbar 90, a rear crossbar 92, and left and right longitudinal members 94 and 96 which are joined to the respective left and right ends of crossbars 90 and 92 to form a generally rectangular rigid framework. Each of crossbars 90 and 92 and members 94 and 96 are generally horizontal and adjacent or seated on floor F or another platform on which the user would stand. Device 1F retains the left and right undulation members 8L and 8R as well as the elastic lines 30A-30D, and pulleys 46 and sheaves 32 and 34 whereby there are front and rear pulleys and sheaves as opposed to upper and lower pulleys and sheaves inasmuch as one set of pulleys and sheaves is forward of the user and the other set is rearward of the user. The forward pulleys and sheaves are mounted via pulley mounts 50 on front crossbar while the rear pulleys and sheaves are mounted on a rear crossbar 92. Frame 6C may be modified in a variety of ways to provide the desired configuration of the lines and pulleys. Lines 30A and 30B along with their corresponding pulleys are spaced from lines 30C and 30D and their pulleys a greater distance than typically used with respect to devices 1, 1D and 1E in order to provide sufficient space along the floor for the user to stand. As shown in FIG. 17, the user will stand with his left and right feet LF and RF on the floor between the set of lines 30A and 30B and the set of lines 30C and 30D and swing his or her left and right hands forward and backward either in unison or in opposite directions from one another as indicated at Arrows DD and EE to correspondingly move the left and right undulation members 8L and 8R and thus move the lines 30A-30D and sheaves 32 in a similar manner as previously described except for the fact that the movement is generally horizontal and generally below the user's hands with the rear segments of the lines 30A-30D at a similar height as the user's feet. The user may also move his hands back and forth from left to right and right to left.

Figure 18:
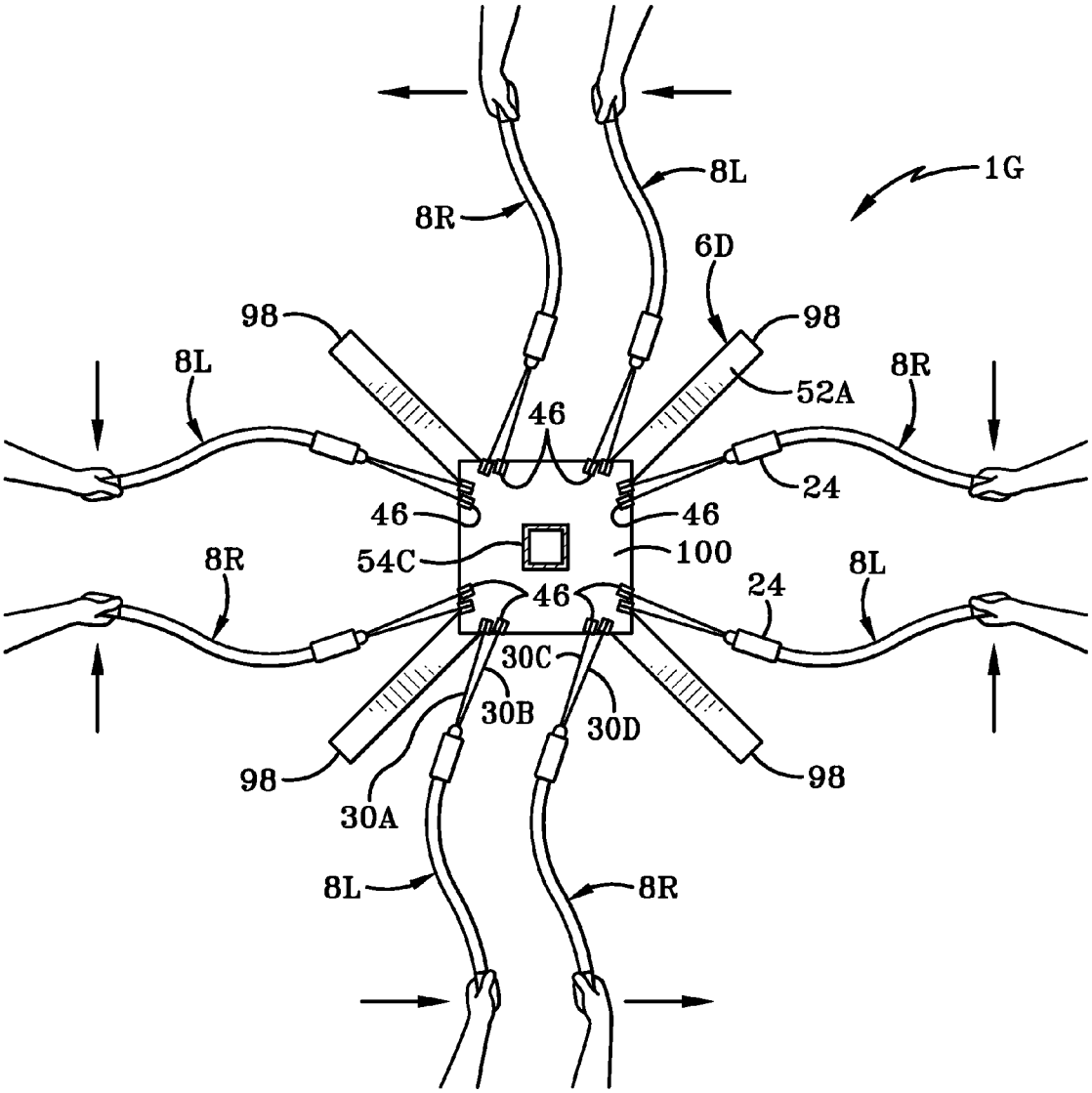
FIG. 18 is a sectional view taken from above of a multi-user station embodiment of the exercise device.

FIG. 18 shows a multi-user station embodiment of the exercise device denoted device 1G. Device 1G includes a rigid frame 6D which may have a base 52A which may include four legs 98 which extend radially outwardly in a horizontal fashion and are adapted to be seated on a floor as is base 52 of device 1. Frame 6D likewise may include a rigid plate 100 or board or other structure along the bottom of the frame and atop legs 98 with an upright 54C extending upwardly from the center of plate 100 vertically upwardly. Frame 6D may also include an upper plate analogous to plate 100 secured to upright 54C adjacent its upper end, Lower pulleys 46 are mounted along plate 100 likewise, and upper pulleys 46 may be mounted on the bottom of an upper plate 100 in order to provide a similar general configuration as shown in exercise device 1 except that device 1G allows for multiple users by providing left and right members 8L and 8R along four sides of device 1G. Likewise, the previously discussed configurations using a U-shaped adjoining member 8U may be used, or the configuration of device 1C with a single pulley may likewise be used in multiple stations as generally shown at FIG. 18. This type of configuration simply allows multiple users to use the undulating members for exercise in a relatively small space which may be provided in a commercial gym or the like. As will be appreciated, multiple different types of frames may be used to provide a mufti-user station for various numbers of users.

Figure 19:
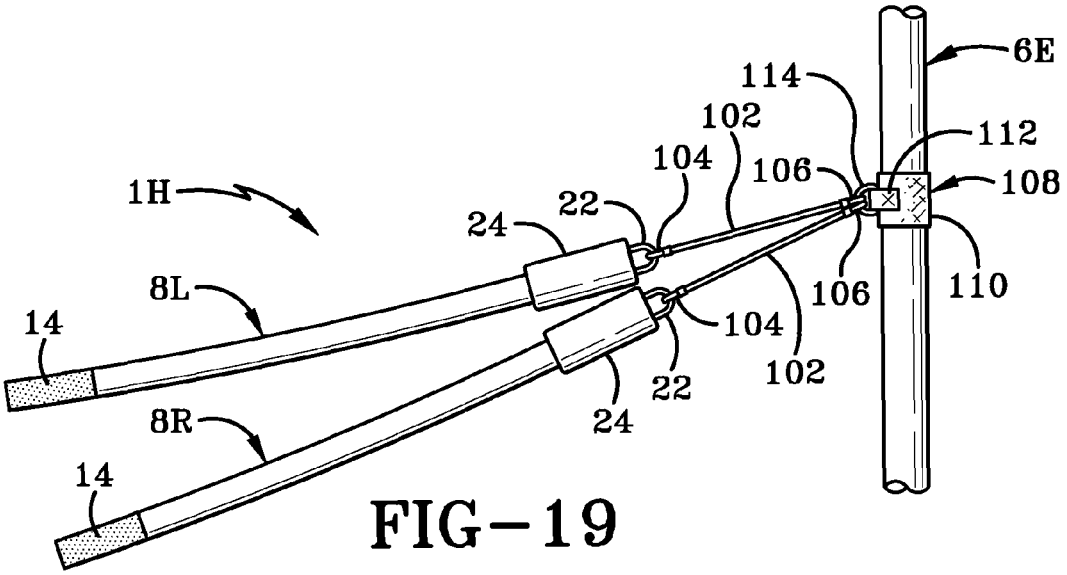
FIG. 19 is a right side elevation view of another embodiment of the exercise device.

FIG. 19 shows an exercise device 1H which is similar to the previous exercise devices except that it eliminates the pulleys and may be mounted in a variety of places. More particularly, device 1H retains undulation members 8L and 8R and includes a shock absorbing assembly which includes an elastic connector line 102 having outer and inner ends 104 and 106 typically formed as loops as previously discussed with other lines. Outer end 104 is linked to a given link 22. Device 1H includes a mounting member or anchor 108 which is configured to mount on a frame or other mounting structure 6E. The frame or mounting structure 6E may be a vertical bar, a horizontal bar or essentially any stationary component which mounting member 108 may be secured to. In the sample embodiment, anchor 108 includes a sleeve 110 which may be removably or non-removably secured around the frame or mounting member 6E. Anchor 108 may include a strap 112 which is secured to sleeve 110, and a typically rigid link 114 which is secured by strap 112 to sleeve 110 and thus to the frame 6E. Inner ends 106 are secured to link 114. In addition to being able to mount device 1H on a pipe or bar, anchor 108 may be configured to be mounted on a door in a variety of manners, including inserting a portion of anchor 108 in between a door frame and edge of the door mounted on the doorframe.

The operation of device 1H is similar to the other devices previously described except that the undulating movement of members 8 via the user's hands in the same manner simply causes the upward and downward or lateral side to side movement and stretching and contracting of the elastic lines 102 in response to the undulating movement. Exercise device 1H is particularly effective and configured to be produced at a low cost. Furthermore, device 1H may be mounted virtually anywhere and takes up a minimum of space while providing substantial exercise opportunities.

Figure 20:
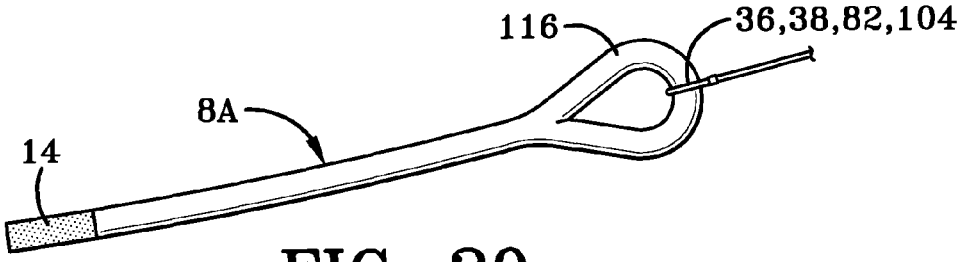
FIG. 20 is a side elevation view of an alternate undulation member of the exercise device.
Figure 21:
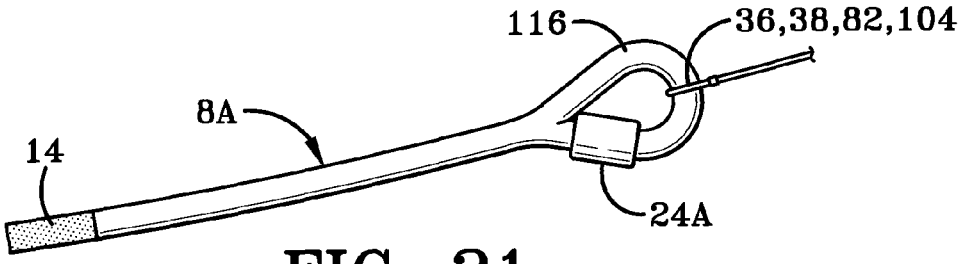
FIG. 21 is a side elevation view of the undulation member of FIG. 20 with a weight member mounted thereon.
Figure 22:
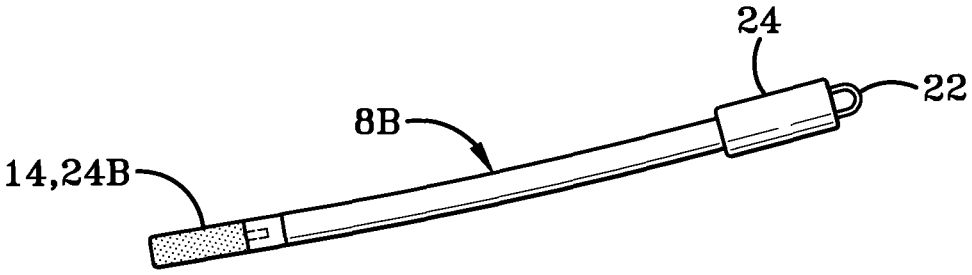
FIG. 22 is an alternate embodiment of an undulation member of the exercise device.
Figure 23:
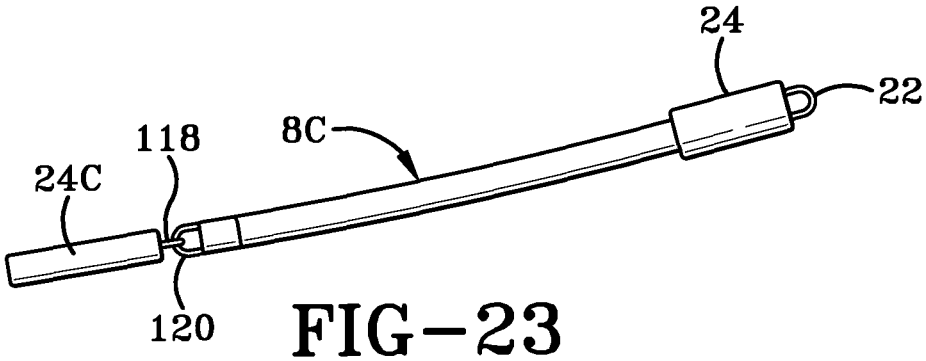
FIG. 23 is a side elevation view of an alternate undulation member of the exercise device.
Figure 24:
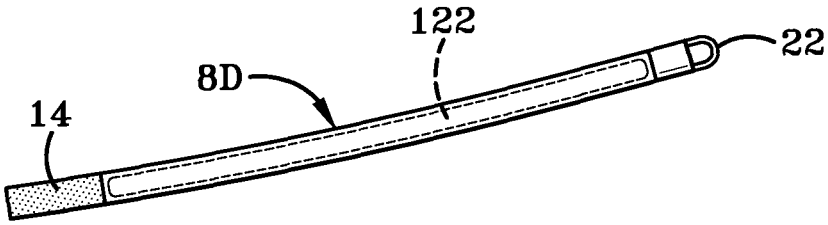
FIG. 24 is a side elevation view of an alternate embodiment of the undulation member of the exercise device.

FIGS. 20-24 illustrate some of the variations of undulating members which may be used with the various exercise devices described above. FIG. 20 shows an undulation member 8A which is similar to undulating members 8L and 8R except that it includes a closed loop 116 along the inner end thereof such that it may be connected to the various looped ends described previously, such as ends 36, 38, 82 and 104. In addition, the loop 116 by itself may provide sufficient weight along the inner end to be useful without the addition of a weight member which is distinct from undulation member 8A. FIG. 21 shows undulation member 8A in use with a weight member 24A which is analogous to weight member 24 and may be easily secured along the closed loop 116 in a manner that substantially prevents weight member 24A from sliding along the length of undulation member 8A. FIG. 22 shows another undulation member 8B wherein the handle 14 also serves as a weight member 24B, typically formed of a solid piece of metal and having a threaded rod which may threadedly engage a threaded hole along an outer end of undulating member 8B. This allows for different weight to be added along the outer end of the undulating member as well as the inner end if desired. FIG. 23 shows another undulation member 80 showing another option for adding a weight such as weight member 24C using a link 118 which is secured to weight member 24C and a link 120 which is secured to the outer end of undulation member 8C. The user may thus also use weight member 24C as the handle or gripping member, thus providing a gripping location of the undulation assembly for use during exercise. FIG. 24 provides another undulation member 8D having a handle 14 along the outer end and a link 22 along the inner end wherein the undulation member defines one or more interior chambers 122 which may be filled with sand or other particulate material or water or another liquid in order to provide additional weight at any given location along the length of member 8D. Thus, any of these handles may be used with the various exercise devices described herein.

Various additional undulation assemblies may be provided within the scope of the invention. For example, an undulation member similar to one of members 8 may be formed with a rope having a steel or other metal cable extending through the center of the rope from one end to the other with a link or closed loop formed at each end of the cable and extending outwardly beyond the ends of the rope, thereby providing links for connecting to the various components as described herein, such as weight members or various loops along the ends of various lines described herein. Moreover, it is noted that although the ropes or undulation members described herein are shown generally as cylindrical in shape, they may be formed with different shapes, such as a generally rectangular cross-sectional shape instead of a generally circular cross-sectional shape.

A bar rod similar to rod 69 of FIG. 12A may be removably connected to the outer ends of members 8L and 8R, and may likewise be formed for instance of two pieces or segments which may likewise be removable from one another whereby the user could separate the two segments of the bar or rod and use those two segments as left and right handles respectively for the left and right undulation members. It will be appreciated that a variety of modifications may be made within the spirit invention. Various exercise devices may be configured with additional resistance members. A resistance mechanism such as mechanism 51, as described above with respect to FIG. 2, may be used with the other embodiments having one or more pulleys. It is also noted that while the various undulation members described herein may involve some degree of stretching, they most typically are formed as substantially non-stretching members.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the invention are an example and the invention is not limited to the exact details shown or described.

The invention claimed is:

1. A method of exercising comprising the steps of:

providing an exercise device which includes a first undulation assembly comprising an elongated first undulation member, and a first shock-absorbing assembly comprising a first elastic line, wherein the first undulation member is operatively connected to the first shock-absorbing assembly, and wherein the shock-absorbing assembly comprises a closed loop which includes the first elastic line and is wrapped around first and second rotatable sheaves;

gripping the first undulation assembly with a first hand at a first gripping location distal the first elastic line; and during the step of gripping, moving the first hand in a back and forth manner to cause undulation of the first undulation member, thereby causing the first elastic line to stretch.

2. The method of claim 1 wherein the first undulation member has first and second ends which define therebetween a first undulation member length which is in a range of about 1 to 7 feet; and the first undulation member has an outer diameter in a range of about 1 to 3 inches.

3. The method of claim 1 wherein the step of moving the first hand comprises moving the first hand in an up and down movement and subsequently moving the first hand in a side to side movement which is perpendicular to the up and down movement.

4. The method of claim 1 wherein the step of providing comprises providing a weight member; and the step of moving the first hand in a back and forth manner causes the weight member to move in a back and forth manner.

5. The method of claim 1 wherein the exercise device comprises a travel line; and the step of moving the first hand in a back and forth manner causes the travel line to travel around and rotate the first sheave.

6. The method of claim 5 wherein the step of moving the first hand in a back and forth manner causes the travel line to travel around and rotate the second sheave.

7. The method of claim 6 wherein the first undulation member includes a portion adjacent the travel line; and the step of moving the first hand in a back and forth manner causes the portion of the first undulation member to move toward the first sheave while moving away from the second sheave, and subsequently to move toward the second sheave while moving away from the first sheave.

8. A method of exercising comprising the steps of:

providing an exercise device which includes a first undulation assembly comprising an elongated first undulation member, and a first shock-absorbing assembly comprising a first elastic line, wherein the first undulation member is operatively connected to the first shock-absorbing assembly;

gripping the first undulation assembly with a first hand at a first gripping location distal the first elastic line; and during the step of gripping, moving the first hand in a back and forth manner to cause undulation of the first undulation member, thereby causing the first elastic line to stretch;

wherein the exercise device comprises a travel line and a first sheave;

the step of moving the first hand in a back and forth manner causes the travel line to travel around and rotate a first sheave around which the travel line is wrapped; and the step of providing comprises providing a resistance mechanism including one of (a) a friction member which frictionally engages the first sheave during rotation thereof to create resistance to rotation of the first sheave while the first sheave rotates, and (b) a magnet which provides a magnetic field to create resistance to rotation of the first sheave while the first sheave rotates.

9. The method of claim 5 wherein the travel line comprises the first elastic line.

10. The method of claim 9 wherein the first elastic line has a first segment extending from adjacent a first point along the first elastic line to the first sheave and a second segment extending from adjacent the first point of the first elastic line to the second sheave.

11. The method of claim 10 wherein the first elastic line has a resting position in which the first and second segments define therebetween an angle in a range of 160 to 180 degrees and an operational position in which the first and second segments define therebetween an angle in a range of 90 to 150 degrees.

12. The method of claim 10 the step of moving the first hand in a back and forth manner causes the first point along the first elastic line to move toward the first sheave while moving away from the second sheave, and subsequently to move toward the second sheave while moving away from the first sheave.

13. The method of claim 8 wherein the shock-absorbing assembly comprises a closed loop which includes the first elastic line and is wrapped around first and second rotatable sheaves.

14. The method of claim 1 further comprising the step of moving the first hand in a semicircular back and forth movement, thereby causing at least a portion of the first undulation member to move in a semicircular back and forth movement.

15. The method of claim 1 wherein the step of providing comprises providing a second undulation assembly comprising an elongated second undulation member, and a second shock-absorbing assembly comprising a second elastic line, wherein the second undulation member is operatively connected to the second shock-absorbing assembly; and further comprising the steps of:

gripping the second undulation assembly with a second hand at a second gripping location distal the second elastic line; and during the step of gripping with the second hand, moving the second hand in a back and forth manner to cause undulation of the second undulation member, thereby causing the second elastic line to stretch.

16. The method of claim 15 wherein the step of moving the first hand comprises the step of moving the first hand in a back and forth manner in first and second opposite directions; and the step of moving the second hand comprises the step of moving the second hand in a back and forth manner in the first and second opposite directions.

17. The method of claim 16 wherein the steps of moving the first and second hands comprise one of (a) moving the first hand in the first direction while the second hand is moving in the second direction and moving the first hand in the second direction while the second hand is moving in the first direction, and (b) moving the first hand in the first direction while the second hand is moving in the first direction and moving the first hand in the second direction while the second hand is moving in the second direction.

18. The method of claim 1 wherein the step of providing comprises providing a second shock-absorbing assembly comprising a second elastic line;

the first undulation assembly has first and second opposed ends;

the first end of the first undulation assembly is operatively connected to the first shock-absorbing assembly;

the second end of the first undulation assembly is operatively connected to the second shock-absorbing assembly; and the step of moving the first hand in a back and forth manner causes undulation of the first undulation assembly, thereby causing the second elastic line to stretch.

19. A method of exercising comprising the steps of:

providing an exercise device which includes an undulation assembly comprising an elongated undulation member having first and second opposed ends, and a shock-absorbing assembly comprising a closed loop which includes an elastic line wrapped around first and second rotatable sheaves; wherein the first end of the undulation member is operatively connected to the shock-absorbing assembly;

gripping the undulation assembly with a hand at a gripping location adjacent the second end of the undulation member; and during the step of gripping, moving the hand in a back and forth manner to cause undulation of the undulation member including back and forth movement of the first end of the undulation member, thereby causing the elastic line to stretch and to travel around and rotate the first and second sheaves.

* * * * *